US007772515B2

(12) United States Patent
Stoving et al.

(10) Patent No.: US 7,772,515 B2
(45) **Date of Patent: *Aug. 10, 2010**

(54) VACUUM SWITCHGEAR ASSEMBLY AND SYSTEM

(75) Inventors: Paul N. Stoving, Oak Creek, WI (US); Michael P. Culhane, Delafield, WI (US)

(73) Assignee: Cooper Technologies Company, Houston, TX (US)

( * ) Notice: Subject to any disclaimer, the term of this patent is extended or adjusted under 35 U.S.C. 154(b) by 178 days.

This patent is subject to a terminal disclaimer.

(21) Appl. No.: 11/673,759

(22) Filed: Feb. 12, 2007

(65) Prior Publication Data

US 2007/0241080 A1 Oct. 18, 2007

Related U.S. Application Data

(63) Continuation-in-part of application No. 11/273,192, filed on Nov. 14, 2005, now Pat. No. 7,488,916.

(51) Int. Cl.
*H01H 33/66* (2006.01)

(52) U.S. Cl. ..... 218/134; 218/139; 218/155

(58) Field of Classification Search ..... 218/118–121, 218/134, 138–140, 152–155
See application file for complete search history.

(56) References Cited

U.S. PATENT DOCUMENTS

| | | | |
|---|---|---|---|
| 3,372,259 | A | 3/1968 | Porter |
| 3,469,050 | A | 9/1969 | Robinson et al. |
| 3,471,669 | A | 10/1969 | Curtis |
| 3,740,511 | A | 6/1973 | Westmoreland |
| 4,032,737 | A | 6/1977 | Huhse et al. |
| 4,071,727 | A | 1/1978 | Crouch et al. |
| 4,124,790 | A | 11/1978 | Kumbera et al. |
| 4,532,391 | A | 7/1985 | Bernt |
| 4,568,804 | A | 2/1986 | Luehring |
| 4,704,506 | A | 11/1987 | Kurosawa et al. |
| 4,839,481 | A | 6/1989 | Nash et al. |
| 4,871,888 | A | 10/1989 | Bestel |
| 4,982,059 | A | 1/1991 | Bestel |
| 5,004,877 | A | 4/1991 | Yin |
| 5,099,093 | A | 3/1992 | Schels et al. |
| 5,175,403 | A | 12/1992 | Hamm et al. |
| 5,252,913 | A | 10/1993 | Falkowski et al. |

(Continued)

FOREIGN PATENT DOCUMENTS

| | | | |
|---|---|---|---|
| DE | 19906972 | A1 | 2/1999 |

(Continued)

OTHER PUBLICATIONS

U.S. Appl. No. 11/881,952, Stoving.

(Continued)

*Primary Examiner*—Renee Luebke
*Assistant Examiner*—Marina Fishman
(74) *Attorney, Agent, or Firm*—King & Spalding LLP

(57) ABSTRACT

Insulated vacuum switchgear and active switchgear elements therefor are provided with a composite overwrap for mechanically isolating a vacuum insulator from axial loads in use without reinforcing or insulating encapsulations. A dielectric buffer layer is provided to fill voids or discontinuities in the overwrap.

48 Claims, 7 Drawing Sheets

U.S. PATENT DOCUMENTS 5,578,805 A * 11/1996 Berger et al. ..... 218/43
5,612,523 A 3/1997 Hakamata
5,667,060 A 9/1997 Luzzi
5,717,185 A 2/1998 Smith
5,736,705 A 4/1998 Bestel et al.
5,747,765 A 5/1998 Bestel et al.
5,747,766 A 5/1998 Waino et al.
5,777,287 A 7/1998 Mayo
5,793,008 A 8/1998 Mayo et al.
5,804,788 A 9/1998 Smith
5,808,258 A 9/1998 Luzzi
5,861,597 A 1/1999 Bolongeat-Mobleu et al.
5,864,942 A 2/1999 Luzzi
5,912,604 A 6/1999 Harvey et al.
5,917,167 A 6/1999 Bestel
6,130,394 A 10/2000 Hogl
6,163,002 A 12/2000 Ahn et al.
6,248,969 B1 6/2001 Komoro et al.
6,362,445 B1 3/2002 Marchand et al.
6,376,791 B1 4/2002 Watanabe et al.
6,479,779 B1 11/2002 Falkingham et al.
6,506,992 B2 1/2003 Kim
6,686,552 B2 2/2004 Nishijima et al.
6,867,385 B2 3/2005 Stoving et al.
6,965,089 B2 11/2005 Stoving et al.
2002/0043514 A1 4/2002 Kim
2002/0144977 A1 10/2002 Kikuchi et al.
2004/0121657 A1 6/2004 Muench et al.
2004/0242034 A1 12/2004 Rinehart et al.
2007/0108164 A1 5/2007 Muench et al.
2007/0241080 A1 10/2007 Stoving et al.

FOREIGN PATENT DOCUMENTS

EP 0782162 A2 7/1997
WO WO 00/41199 7/2000

OTHER PUBLICATIONS

U.S. Appl. No. 11/758,136, Stoving.
Greenwood, Allan, Vacuum Switchgear, The Institution of Electrical Engineers, London United Kingdom; 1994, pp. 109, 124-126.
U.S. Appl. No. 11/881,952, Stoving et al.
U.S. Appl. No. 11/673,759, Stoving et al.
U.S. Appl. No. 11/758,136, Stoving et al.

* cited by examiner

VACUUM SWITCHGEAR ASSEMBLY AND SYSTEM

CROSS REFERENCE TO RELATED APPLICATIONS

This application is a continuation-in-part application of U.S. application Ser. No. 11/273,192 filed Nov. 14, 2005 now U.S. Pat. No. 7,488,916, the disclosure of which is hereby incorporated by reference in its entirety.

BACKGROUND OF THE INVENTION

This invention relates generally to high voltage switchgear, and more particularly, to vacuum switch or interrupter assemblies for use in such switchgear.

Utility companies typically distribute power to customers using a network of cables, transformers, capacitors, overvoltage and overcurrent protective devices, switching stations, and switchgear. Switchgear is high voltage (e.g. 5 kV-38 kV) equipment used to distribute and control power distribution. Improvements in the power distribution system, and particularly the switchgear used to control the electrical system, are desirable from both from the perspective of electrical utility firms and their customers.

DETAILED DESCRIPTION OF THE INVENTION

Figure 1:
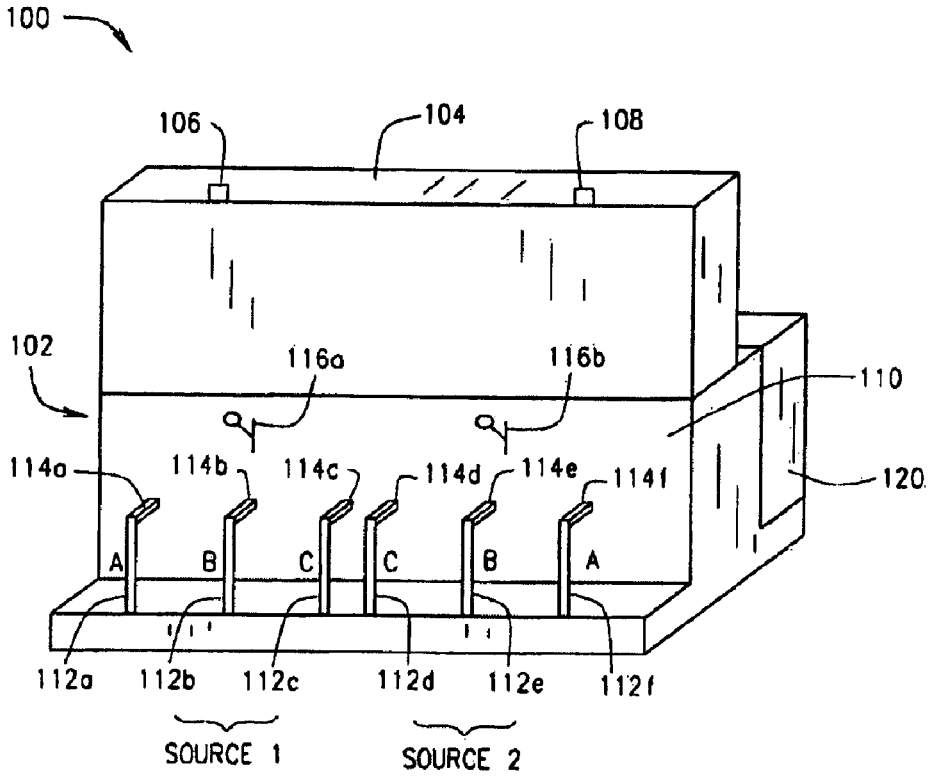
FIG. 1 is a perspective view of electrical switchgear in accordance with an exemplary embodiment of the present invention viewed from a source side of the switchgear.

Exemplary embodiments of switchgear and active element modules therefore are disclosed hereinbelow that overcome certain problems in the art. In order to appreciate the invention to its fullest extent, the disclosure herein will be segmented into different segments or parts, wherein Part I discusses convention switchgear and active elements therefore and problems associated therewith; and Part II discloses exemplary embodiments of the invention.

I. Introduction to the Invention

Various types of switchgear are known for electrical power distribution and control systems, and known switchgear systems are prone to certain disadvantages.

Padmounted or underground switchgear includes an enclosure or container that houses bushings, insulation, a bus bar system, and a collection of active switching elements. The active switching elements may include internal active components, such as a fuse, a switch, or an interrupter and external points of connection, such as bushings, to establish line and load connections to an electrical distribution system. Distribution cables transmit power at high voltages. These cables are typically coupled to the switchgear through the switchgear bushing cable connectors. The bushings, in turn, couple to, or form an integral part of, the active switching elements inside the switchgear. The active switching elements are coupled together by a bus bar system in the switchgear assembly.

Other types of switchgear besides padmounted or underground switchgear include switchgear that is used on an overhead distribution system or used in a vault below grade or within load-rooms inside buildings. Such types of switchgear share similar structural and operational components to padmounted switchgear, but are mounted slightly differently and may be connected differently with for example, bare wires instead of insulated cables.

Regardless of the type of switchgear, the active switching elements may be used to open and/or close one or more circuit paths through the switchgear automatically, manually, or remotely. One type of active switching element may be a vacuum switch or interrupter having a movable contact that engages or disengages a fixed contact within a vacuum chamber, often formed in a cylindrical tube or bottle. End caps or plates may be attached to the opposite ends of the bottle, and the fixed contact may be maintained in a stationary manner relative to one of the end caps, while the movable contact is axially positionable with respect to the fixed contact within the bottle. The movable contact may be actuated by an operating mechanism to engage or disengage the movable contact to and from the fixed contact within the vacuum chamber in the bottle.

Known vacuum switch or interrupter devices include a rigid reinforcing structure, such as an epoxy or rigid polymeric molding or casting, encapsulating the bottle. The structure is provided to hold and position the vacuum bottle, typically fabricated from ceramic or glass, and the fixed and movable contacts of the bottle with respect to the operating mechanism. In one such device, an elastomeric sleeve surrounds the bottle, and the sleeve is intended to isolate the bottle from the casting and reduce stress on the vacuum bottle as it is encapsulated within the rigid casting and cured at high temperatures.

It has been found, however, that either the bottle or the casting can nonetheless experience breakage due to thermal, mechanical, or electrical stress as the device is used. The materials used to fabricate the casting and the bottle may have different thermal coefficients of expansion, and heat generated by making (closing the contacts), breaking the circuit (opening the contacts), and interrupting fault currents can be significant, which causes the materials to expand rapidly at different rates. Thermal contraction, when cooling after a manufacturing process such as molding, may also cause thermal stress as the materials contract at different rates. Thermal cycling due to seasonal changes from summer to winter or a daily change from day to night may also produce thermal stress, and the cumulative effects of thermal stress may lead to fatigue and premature failure of the device.

Other known vacuum switch or interrupter devices include elastomeric materials for insulation and shielding purposes. For example, a vacuum bottle may be placed within a rigid wound fiberglass tube. The fixed contact may be secured to one end of the tube and the operating mechanism to the other. A secondary elastomeric filler layer fills a space between the bottle and the tube in an attempt to isolate the bottle mechanically from the rigid tube. The tube assembly, including the bottle and the filler layer, may be placed within an elastomeric housing that provides electrical shielding and insulation for the device.

Despite such efforts to isolate the vacuum bottle from mechanical stress, misalignment of the switch or interrupter devices can nonetheless cause the bottle and/or support structure to break due to mechanical forces associated with opening and closing of the contacts in use. If, for example, an actuator shaft of the operating mechanism is misaligned, however slightly, with the axis of the switch or interrupter device, the bottle, and not the supporting structure for the bottle, can become subject to mechanical loads during opening and closing of the contacts. Depending upon the severity and frequency of such loads, the structural integrity of the bottle can be compromised, and perhaps even destroyed. Loading of the bottle due to misalignment of the bottle with respect to the operating shaft may further cause the switch or interrupter to bind, thereby preventing proper opening and closing of the bottle contacts.

Additionally, some known vacuum switch or interrupter devices are susceptible to slight movement of the bottle with respect to the operating mechanism for the bottle, which presents reliability issues in operation, particularly to those using elastomeric housings. If the bottle is not mounted in a manner that assures the fixed contact end of the bottle is secure and cannot move with respect to the shaft of the operating mechanism, the operating mechanism may not fully open and separate the movable contact from the fixed contact. Alternatively, relative movement between the bottle and the operating mechanism may prevent the operating mechanism from fully closing and engaging the movable contact of the vacuum bottle with respect to the fixed contact. The switch contacts must be fully opened or closed for proper functioning. Further, the switch contacts must be held closed with considerable force applied to the movable contact to hold the movable contact tightly against the fixed contact. If this condition is not met, undesirable arcing conditions may occur between the fixed and movable contacts or the fixed and movable contacts may weld together. Additionally, looseness or play in the mounting of the bottle may contribute to bounce between the contacts as they are closed, and this is detrimental to both the mechanical and electrical interface between the contacts. Bounce can also be a source of stress that weakens the bottle, and may cause the switch contacts to weld together.

In a solid dielectric insulated vacuum switch or interrupter device, insulating layers keep internal conductive elements of the device, which may be energized at either high voltage or electrically grounded, electrically isolated from each other. Furthermore, an external ground shield is sometimes, but not necessarily, provided to maintain outer surfaces of the device at ground potential for safety reasons. This ground shield must also be electrically isolated from the energized components. Electrical isolation between potentials is necessary to prevent faults in the electrical system. There are applications, chiefly on an overhead system, where the ground shield may not be required because a physical separation of energized components and ground may provide sufficient electrical isolation. In either case, power interruption to line-side connections of the electrical system fed by the device is prevented. Damage to the device itself or to surrounding equipment is also prevented, and people in the vicinity of the switchgear, including but not limited to maintenance workers and technicians, are protected from hazardous conditions. Providing such insulation in a cost effective manner so as to allow the device to withstand the applied voltage and to isolate the circuit when the switch contacts are in the open position is a challenge.

If the air present within the structure is sufficiently stressed, it may breakdown, resulting in a measurable partial discharge. This breakdown may attack the surrounding insulation, ultimately resulting in failure of the insulation system. Therefore, in addition to the external shields, internal cavities in devices with either an external shield or with internal conductive elements at differing electrical potentials that are in close proximity to each other may be surrounded by rubber shields. Theses shields ensure that any air present within the cavity does not have a voltage gradient across it. Eliminating the possible voltage differential eliminates the electrical stress across the air in the cavity, thereby preventing partial discharge and the resulting insulation degradation.

It is desirable to provide a mounting structure and insulation for vacuum switch or interrupter devices that more capably withstands thermal stress and cycling in use, improves reliability of the switchgear as the contacts are opened and closed, simplifies manufacture and assembly of the devices and associated switchgear, and provides cost advantages in relation to known switch or interrupter devices and associated switchgear.

II. Inventive Switchgear Systems and Modules

FIG. 1 illustrates an exemplary switchgear configuration 100 in which vacuum switch or interrupter assemblies according to the present invention may be used. While one exemplary switchgear 100 is described, it is understood that the benefits of the invention accrue generally to switchgear of many configurations, and that the switchgear 100 is but one potential application of the switch or interrupter assemblies described hereinbelow. Switchgear 100 is therefore illustrated and described herein for illustrative purposes only, and the invention is not intended to be limited to any particular type of switchgear configuration, such as the switchgear 100.

Figure 2:
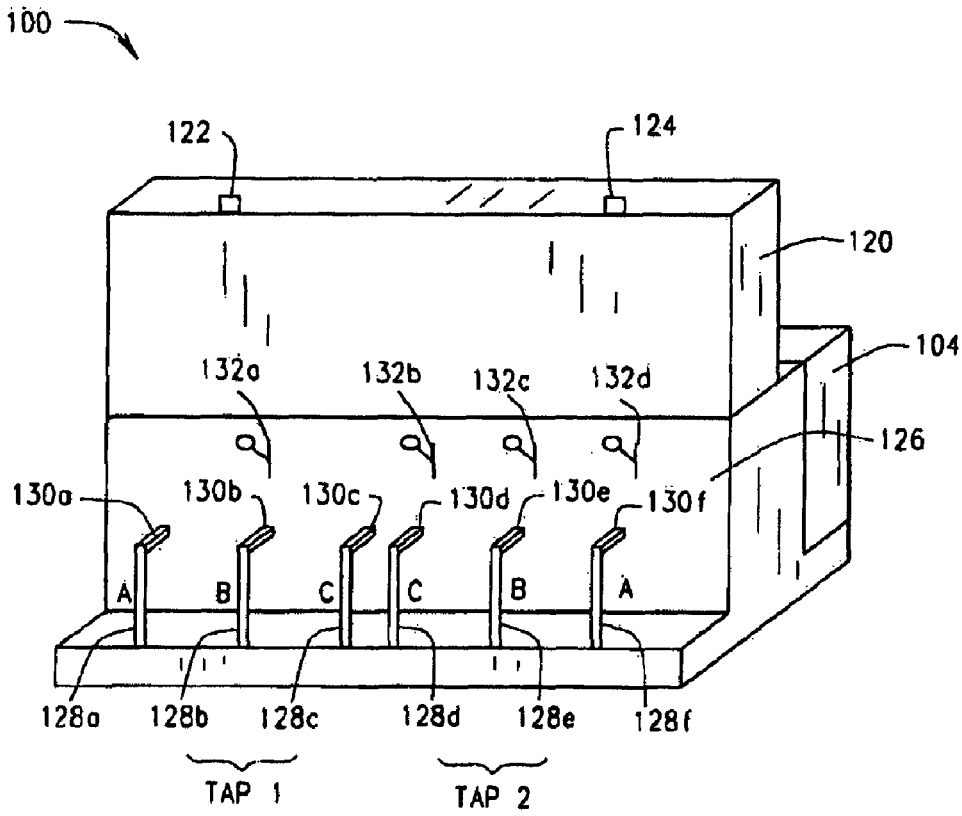
FIG. 2 is another perspective view of the switchgear shown in FIG. 1 viewed from a tap side of the switchgear.

As shown in FIG. 1, the switchgear 100 includes a protective enclosure 102 having, for example, a source side door 104 positionable between an open position (FIG. 1) and a closed position (FIG. 2). Latch elements 106 and/or 108 may be used to lock source side door 104 in a closed position. Inside the source side door 104 is a front plate 110 that forms a portion of the enclosure 102. Cables 112*a*-112*f* may be coupled to a lower end of the enclosure 102 and are connected to active switching elements (described below) in the enclosure 102, and each of the cables 112*a*-112*f* typically carry power in three phases from two different sources. For example, cables 112*a*-112*c* may carry, respectively, the A, B and C phases of power from source 1, and cables 112*d*-112*f* may carry, respectively, the C, B and A phases of power from source 2.

Cables 112*a*-112*f* may be coupled to the front-plate 110 and switchgear 100 through, for example, connector components 114*a*-114*f* that join the cables 112*a*-112*f* to respective switching elements (not shown in FIG. 1) in the enclosure 102. The switching elements may, in turn, be coupled to an internal bus bar system (not shown in FIG. 1) in the enclosure 102.

Handles or levers 116*a* and 116*b* are coupled to the enclosure 102 and may operate active switchgear elements (described below) inside the switchgear 100 to open or interrupt the flow of current through the switchgear 100 via the cables 112*a*-112*f* and electrically isolate power sources 1 and 2 from load-side or power receiving devices. The cables 112*a*-112*c* may be disconnected from the internal bus bar system by manipulating the handle 116*a*. Similarly, cables 112*d*-112*f* may be disconnected from the internal bus bar system by manipulating the handle 116*b*. Handles 116*a* and 116*b* are mounted onto the front-plate 110 as shown in FIG. 1. In an exemplary embodiment, the active switch elements on the source side of the switchgear 100 are vacuum switch assemblies (described below), and the vacuum switch assemblies may be used in combination with other types of fault interrupters and fuses in various embodiments of the invention.

One exemplary use of switchgear is to segregate a network of power distribution cables into sections such as, for example, by opening or closing the switch elements. The switch elements may be opened or closed, either locally or remotely, and the power supplied from one source to the switchgear may be prevented from being conducted to the other side of the switchgear and/or to the bus. For example, by opening the switch levers 116*a* and 116*b*, power from each of the sources 1 and 2 on one side of the switchgear is prevented from being conducted to the other side of the switchgear and to the bus and the taps. In this manner, a utility company is able to segregate a portion of the network for maintenance, either by choice, through the opening of switchgear, or automatically for safety, through the use of a fuse or fault interrupter, depending on the type of active switching elements included in the switchgear.

FIG. 2 illustrates another side of the switchgear 100 including a tap side door 120 that is positionable between open (shown in FIG. 2) and closed (FIG. 1) positions in an exemplary embodiment. Latch elements 122 and/or 124 may be used to lock the tap side door 120 in the closed position. Inside the tap door 120 is a front-plate 126 that defines a portion of the enclosure 102. Six cables 128*a*-128*f* may be connected to a lower side of the switchgear 100, and each of the respective cables 128*a*-128*f* typically carries, for example, one phase of power away from switchgear 100. For example, cable 128*a* may carry A phase power, cable 128*b* may carry B phase power and cable 128*c* may carry C phase power. Similarly, cable 128*d* may carry C phase power, cable 128*e* may carry B phase power and cable 128*f* may carry A phase power. Connectors 130*a*-130*f* connect cables 128*a*-128*f* to switchgear.

It should be noted that the exemplary switchgear 100 in FIGS. 1 and 2 shows one only one exemplary type of phase configuration, namely an ABC CBA configuration from left to right in FIG. 2 so that the corresponding cables 128*a*-128*c* and 128*d*-128*f* carry the respective phases ABC and CBA in the respective tap 1 and tap 2. It is understood, however, that other phase configurations may be provided in other embodiments, including but not limited to, AA BB CC so that cables 128*a* and 128*b* each carry A phases of current, cables 128*c* and 128*d* each carry B phases of current, and so that cables 128*e* and 128*f* each carry C phases of current. Still other configurations of switchgear may have one or more sources and taps on the same front-plate 110 (FIG. 1) or 126 (FIG. 2), or on the sides of the switchgear on one or more additional front plates. It also contemplated that each phase may be designated by a number, such as 1, 2 and 3, and that the switchgear may accommodate more or less than three phases of power. Thus, a switchgear may have, for example only, a configuration of 123456 654321 on the tap side of the switchgear 100.

A frame may be positioned internal to the switchgear and provide support for the active switching elements as well as the bus bar system, described below. In other words, the frame holds the active switching elements and bus bar system in place once they are coupled to the frame. The frame is oriented to allow portions of the active switching elements, typically bushings, to protrude as a bushing plane so that connections to the various cables can be made.

In an exemplary embodiment, a lever or handle 132*a* operates active switchgear elements, as described below, inside the switchgear 100 to disconnect cables 128*a*, 128*b*, 128*c* from the internal bus bar system. Similarly, handles 132*b*-132*d* cause one of individual cables 128*d*, 128*e*, 128*f* to disconnect and connect, respectively, from the internal bus bar system. In an exemplary embodiment, the active switchgear elements on the tap side of the switchgear 100 include vacuum interrupter assemblies (described below), and the vacuum interrupter assemblies may be used in combination with fuses and various types of fault interrupters in further and/or alternative embodiments of the invention.

Figure 3:
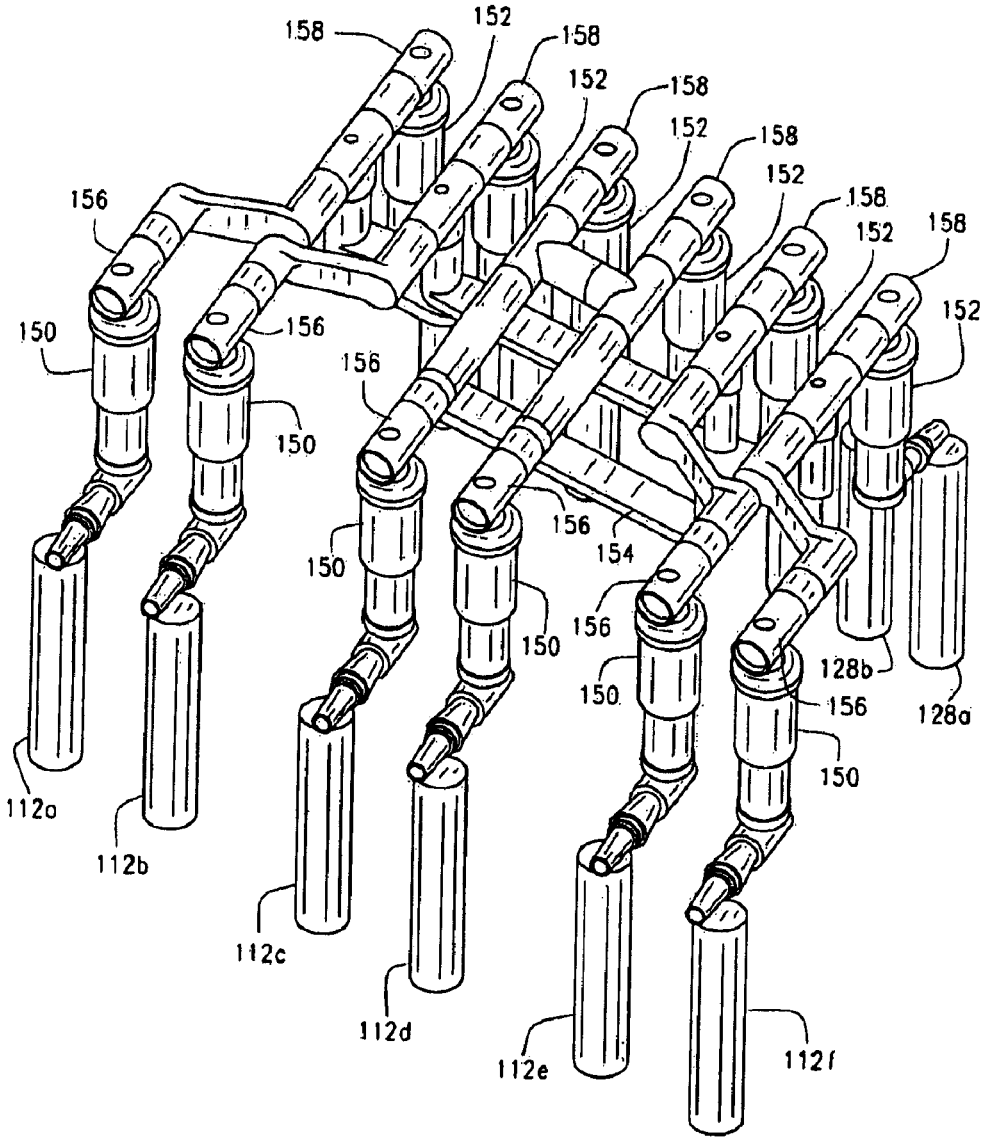
FIG. 3 is a perspective view of internal components of the switchgear shown in FIGS. 1 and 2.

FIG. 3 is a perspective view of exemplary internal components of the switchgear 100 removed from the enclosure 102 and without the supporting frame. Switch element assemblies 150 and fault interrupter assemblies 152 may be positioned on opposites sides (i.e., the source side and the tap side, respectively) of the switchgear assembly. Cables 112*a*-112*f* may be connected to respective switch element assemblies 150, and cables 128*a*-128*f* (cables 128*c* -128*f* not labeled in FIG. 3) may be connected to the respective interrupter element assemblies 152.

A bus bar system 154 may be situated in between and may interconnect the switch element or interrupter assemblies 150 and 152 via connectors 156 and 158. In different embodiments, the bus bar system 154 includes conventional metal bar members formed or bent around one another, or a modular cable bus and connector system. The modular cable bus system may be assembled with mechanical and push-on connections into various configurations, orientations of phase planes, and sizes of bus bar systems. In still another embodiment, molded solid dielectric bus bar members may be provided in modular form with push-on mechanical connectors to facilitate various configurations of bus bar systems with a reduced number of component parts. In still other embodiments, other known bus bar systems may be employed as those in the art will appreciate.

Figure 4:
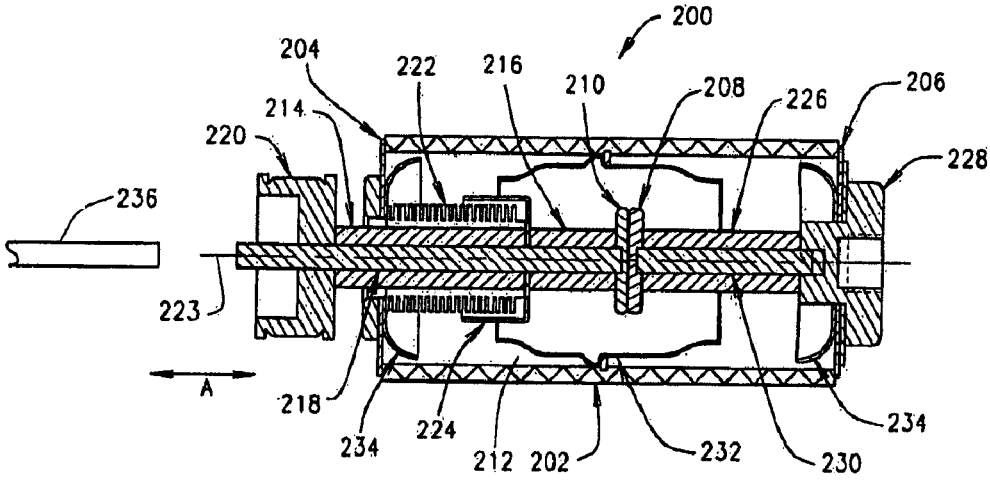
FIG. 4 is a cross sectional view of an exemplary vacuum bottle assembly which may be used with the present invention.

FIG. 4 is a cross sectional view of an exemplary vacuum bottle assembly 200 which may be used in one or more of the active switch element or interrupter assemblies 150, 152 in the switchgear 100 (shown in FIGS. 1-3).

The bottle assembly 200 includes an insulator 202, end plates 204 and 206 coupled to either end of the insulator 202, a fixed contact 208 mounted in a stationary manner to the end plate 206, and a movable contact 210 that is selectively positionable relative to each of the end plates 204 and 206 and the fixed contact 208 to complete or break a conductive path through the bottle assembly 200. Depending upon the position of the movable contact 210 relative to the fixed contact 208, the bottle assembly 200 may be used to conduct electrical current through the assembly, or, in the alternative, to open or interrupt the current path through the assembly 200.

The insulator 202 may be fabricated from a substantially non-conductive or insulating material such as glass, ceramic, or other suitable material known in the art into a cylindrical or tubular shape or form having a central opening or bore 212 extending between the opposite ends of the bottle wherein the end caps 204, 206 are attached in a known manner. In different embodiments, the insulator 202 may be fabricated integrally in a one-piece construction, or alternatively may be fabricated from multiple pieces joined together to form a unitary construction. The insulator 202 positions and locates the other components of the assembly 200 and provides electrical insulation when the contacts 208, 210 are separated.

An external conducting rod 214 defines a conductive path through the end cap 204 to the interior bore 212 of the bottle assembly 200. A second, internal, conducting rod 216 is coupled to the rod 214 and defines a conductive path to the movable contact 210 which is mounted thereto. A reinforcing rod 218, fabricated from stainless steel in one embodiment, provides mechanical strength to the combination of the rods 214 and 216. In an alternative embodiment the external and internal conducting rods 214 and 216 may be replaced with a single conductive rod.

A piston-shaped current exchange 220 is mounted to an exterior end of the conducting rod 214 protruding from the bottle through the end plate 204. The current exchange 220 is configured for electrical connection to an external current exchange (described below) that may be connected to a power cable, such as one of the cables 112*a*-112*f* and 128*a*-128*f* shown in FIGS. 1 and 2. In alternative embodiments, electrical connection to an external current exchange and/or power supply cables may be provided via conductive braids, flexible leads, or other known connection schemes in lieu of the current exchange 220.

A flexible metallic bellows 222 is situated in the bore 212 of the bottle assembly 200 and the bellows 222 extends between the end plate 204 and common ends of conducting rods 214 and 216. The bellows 222 surrounds the rod 214 within the bore 212 of the bottle assembly 200. The flexible bellows 222 allows the rods 214, 216 and the movable contact 210 to move along an axis 223 of the bottle assembly 200 in the directions of arrow A while maintaining a vacuum seal within the bottle assembly 200.

A shield 224 partly surrounds and protects the bellows 222 from damaging metallic splatter and vapor that may be generated during a high-current interruption when the movable contact 210 is separated from the fixed contact 208.

The stationary contact 208 is coupled to an internal rod 226, and the internal rod 226 is, in turn, coupled to an external contact 228 to provide an external electrical conductive path and connection to the stationary end of the bottle assembly 200. The external contact 228 also rigidly connects with the end plate 206. A stainless steel reinforcing rod 230 may be provided to strengthen the conductive rod structure at the stationary end of the bottle assembly 200.

An internal shield 232 partly surrounds the contacts 208 and 210 in the bore 212 of the bottle assembly 200, and along with end shields 234, the shield 232 provides for proper screening and control of the electric field within the bottle assembly 200. These shields 232, 234 define a location where any by-products that may result from electrical arcing when the movable contact 210 is separated from the stationary contact 208 may condense, thereby protecting the insulation integrity of the insulator 202.

Once the components are assembled, the bottle assembly 200 is placed into a large vacuum chamber, where gases are removed from the bottle assembly 200. Brazing materials are placed between the components at appropriate places to ensure electrical connection and airtight sealing between component parts, and while the assembly 200 is within the vacuum chamber, the assembly 200 is heated to a temperature wherein the brazing materials melt and reflow. When the assembly 200 returns to room temperature, a hard vacuum is created within the vacuum bottle assembly 200. A hard vacuum has a very high dielectric strength that quickly recovers should an arc result when the movable contact 210 is separated from the fixed contact 208. Additionally, because no oxidation of the contacts 208, 210 can occur within the vacuum, the assembly 200 is a very effective way to carry current in a switch or interrupter element assembly, such as the switch or interrupter element assemblies 150 and 152 shown in FIG. 3. The assembly 200 also provides for effective interruption of current at high voltage. For example, current can be effectively interrupted at voltages of about 38 kV with as little as 0.5 inches or less of movement of the movable contact 210 relative to the fixed contact 208 along the axis 223.

An actuator element, such as an actuator shaft 236 is driven by an actuating mechanism known in the art to move the movable contact 210, via the rod 218, in the directions of arrow A between opened and closed positions. In the opened position, the movable contact 210 is moved away from the fixed contact 208 (to the left in FIG. 4) to separate the contacts. In the closed position (shown in FIG. 4), the movable contact 210 is pressed against the fixed contact 208 to complete a conductive path through the contacts. On interrupter versions of the device a sensor and trigger system (not shown) may be used to sense the presence of a fault current flowing into the bottle assembly 200. After the fault is sensed, the trigger system causes movement of the shaft 236 to separate the contacts 210, 208 and interrupt the conductive path therebetween, thereby opening the circuit through the bottle assembly 200.

Holding and supporting the bottle assembly 200 is important so that sufficient force is applied through the movable contact 210 to allow efficient current interchange between the fixed and movable contacts 208, 210 when the contacts are closed. Any "softness" or play in the mounting of the bottle assembly 200 can cause a decrease in contact force when the contacts are closed, which can result in the contacts 210, 208 welding together or bursting open. The vacuum insulator 202, as well as its braze joints to the end caps 204, 206, is relatively strong but can be broken if excessive force is placed on it during operation of the assembly 200. Such force may result from misalignment of the bottle assembly 200 with respect to the operating mechanism that moves the movable contact 210 such as, for example, when the force that moves the movable contact 210 is not in line with the axis 223 of the bottle assembly 200. Force on the bottle may also result from differential expansion rates experienced by the insulator 202 and the structures that hold and support it while current is being carried or interrupted, or simply from the mounting structure that holds the bottle in place.

As will now be explained in detail, the present invention provides supporting structures for mounting the bottle assembly 200 in a manner that avoids the above-mentioned mounting issues. Additionally, the present invention provides adequate shielding and insulation of the bottle assembly 200 and supporting structures to be sure that the applied voltage such as, for example, 1 to 38 kV, does not cause a breakdown in or near the assembly 200. Additionally, a high voltage AC withstand may be up to 70 kV rms, and impulse voltages may be up to 150 kV peak, and the shielding and insulation of the bottle assembly 200 ensure that these voltages do not cause a breakdown in or near the assembly 200. If a breakdown were to occur, a fault would occur on the larger electrical system, potentially damaging other equipment, while preventing power from reaching customers connected to the switchgear 100 through the bottle assembly 200.

Figure 5:
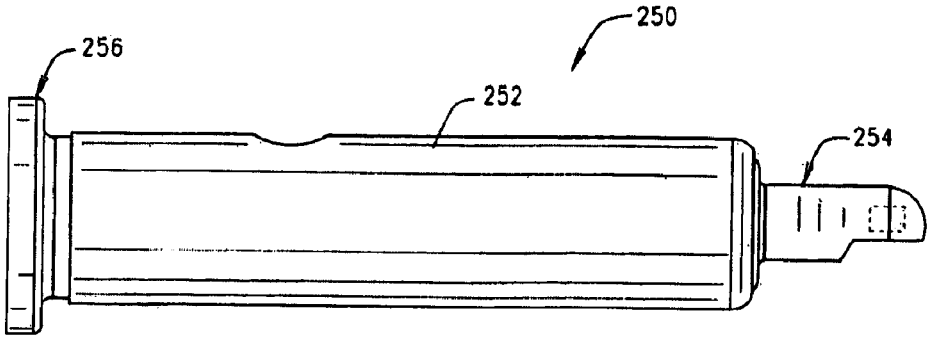
FIG. 5 is a side view of a switch or interrupter module according to one embodiment of the present invention.

FIG. 5 is a side view of an exemplary switch or interrupter module 250 according to one embodiment of the present invention. The switch or interrupter module 250 may be used in, for example, the active switching or interrupting element assemblies 150 and 152 (shown in FIG. 3) in the switchgear 100 (FIGS. 1 and 2), although it is recognized that the switch or interrupter module 250 may be used in other types of switchgear and other types of equipment as desired. The switch or interrupter module 250 may further be used in subsurface, overhead or above ground installations, or even submerged or underwater installations in a power distribution system.

The module 250 includes a mounting structure 252 that receives, protects, and supports the bottle assembly 200 (FIG. 4). A stationary contact 254 extends outwardly from one end of the support structure 252 and is rigidly connected to the stationary end of the bottle assembly 200 and an actuator throat connector 256 extends outwardly from the opposite end of the support structure 252. The throat connector 256 engages and connects to, for example, the operating mechanism that operates the actuator shaft 236 (FIG. 4) to open and close the conductive path through the bottle assembly 200 by moving the movable contact 210 relative to the fixed contact 208 (FIG. 4).

Figure 6:
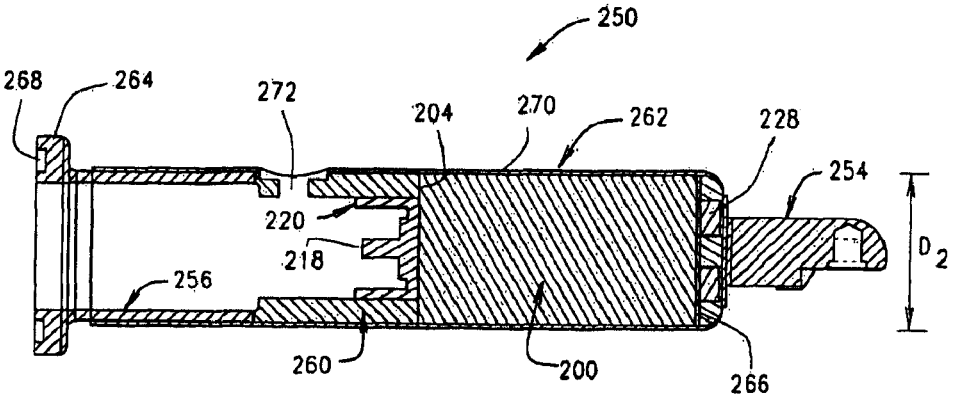
FIG. 6 is a cross sectional view of the switch or interrupter module shown in FIG. 5.

FIG. 6 is a cross sectional view of the switch or interrupter module 250 including the bottle assembly 200, an external current interchange 260 adjacent to the bottle end plate 204 (FIG. 4), the throat connector 256, and the stationary contact 254, all of which are secured and maintained in position relative to one another with a composite overwrap layer 262 as explained below.

The external current interchange 260 is cylindrical or tubular in shape in one embodiment, and the external current exchange surrounds and provides a mechanical and electrical interface with the current exchange 220 of the bottle assembly 200. A portion of the reinforcing rod 218 (also shown in FIG. 4) of the bottle assembly 200 extends axially from the bottle end plate 204 and is surrounded by the internal current exchange 220. The reinforcing rod 218 of the bottle assembly 200 includes, for example, threads or other features to attach and engage the actuator shaft 236 (FIG. 4) of the operating mechanism. The throat connector 256 is aligned with and is adjacent to an end of the external current exchange 260.

An end 264 of the throat connector 256 is formed into a rim or flange that mates with the operating mechanism (not shown) so that the fixed contact end or stationary end 266 of the bottle assembly 200 is held rigidly with respect to the operating mechanism, through the overwrap layer 262. The rigid connection allows the operating shaft 236 (shown in FIG. 4) to provide the proper contact movement and cause the shaft 236 to hold the contacts 210, 208 (FIG. 4) closed with the proper force. The end 264 of the throat connector includes an annular groove 268, and a gasket (not shown in FIG. 6) is seated in the groove 268 between the module assembly 250 and the operating mechanism in an exemplary embodiment.

The contact 254 is attached to the stationary end 266 of the bottle assembly 200, and in an illustrative embodiment the contact 254 includes two parts that are threaded together, although it is appreciated that various types of contacts may be used in single or multiple pieces attached to one another by any of a variety of techniques known in the art. The contact 254 is mechanically and electrically engaged to the external contact 228 of the bottle assembly 200.

When the bottle assembly 200, the external current exchange 260, the throat connector 256, and the contact 254 are aligned and assembled with one another, the assembly of components is placed in a fixture and a solid but flexible composite wrap is applied over substantially the entire outer surface of the components. The composite wrap is applied directly to and is in intimate contact with the outer surface of the bottle and is wrapped about the bottle and the outer surfaces of the other components. The composite material defines a void free contact interface with the bottle outer surface 270 that is substantially, if not completely, devoid of air gaps that could produce an electrical discharge. Once applied to the outer surfaces of the component assembly, the composite wrap is then subjected to chemical, thermal, UV radiation, or other curing process to cause a binding material in the composite wrap material to polymerize and cross-link, creating the rigid, self supporting overwrap layer 262.

Because the composite wrap is applied to the components as a flexible solid material in sheet form, the composite wrap has a definite shape and volume when applied to the components, unlike liquid materials having no definite shape or volume that are commonly used in casting, molding, coating, and other known encapsulant processes wherein the liquid materials are subsequently cured or hardened to a solid form around a bottle assembly. The solid and flexible composite wrap is also unlike known liquid and gas insulation materials and dielectrics having no definite shape and form that are sometimes used to encapsulate or surround the bottle by, for example, immersion of the bottle in such materials. By avoiding such liquid or gaseous materials for insulation purposes, the definite volume and shape of the overwrap layer simplifies the manufacture of the bottle assembly 200 and its installation into switchgear.

In one exemplary embodiment, the composite wrap material used to form the overwrap layer 262 includes structural material such as fiberglass, Kevlar™ or other matting or continuous strands of insulating material embedded in a polymeric compound that becomes rigid when it is fully cured. One such material is commercially available from J.D. Lincoln, Inc. of Costa Mesa, Calif. and is designated as L-201-E, although similar materials from other suppliers may be used. Advantageously, the overwrap layer 262 provides structural strength to resist structural loads as the bottle assembly 200 is actuated to open and close the contacts 210, 208 therein.

Additionally, and unlike known filled epoxy encapsulants for the bottle, the embedded insulating material in the composite material used to form the overwrap layer 262 reduces the coefficient of thermal expansion of the overwrap layer 262 to a value approximately equal to the coefficient of thermal expansion of the embedded insulating material, which is of similar order to or approximately equal to the coefficient of thermal expansion of the ceramic insulator 202 in the bottle, even while the coefficient of thermal expansion of the epoxy or other binding resin employed in the composite material is different from the bottle.

In one exemplary embodiment, the bottle is fabricated from alumina ceramic material having a coefficient of thermal expansion within a range of about 2 to about $20\times10^{-6}$ mm/mm/degrees C., and more specifically in a range of about 5 to about $10\times10^{-6}$ mm/mm/degrees C. over a temperature range of −40° C. to about 160° C. For purposes of comparison, the composite wrap material has, for example, a coefficient of thermal expansion within a range of about 11 to about $50\times10^{-6}$ mm/mm/degrees C. Also for purposes of comparison, a known filled epoxy has a coefficient of thermal expansion within a range of about 25 to $50\times10^{-6}$ mm/mm/degrees C. in the temperature range of −40° C. to about 100° C., and a coefficient of thermal expansion within a range of about 80 to $120\times10^{-6}$ mm/mm/degrees C. in the temperature range of 100° C. to about 160° C.

Because the coefficients of expansion are of similar order between the alumina ceramic insulator material and the composite wrap material when cured, thermal stress associated with temperature cycling and heat attributable to current loads and making and breaking of the contacts 210, 208 in the bottle assembly 200 is therefore avoided because that bottle assembly 200 and the overwrap layer 262 expand and contact with temperature at approximately the same rate. The reduction in thermal expansion provided by the continuous reinforcement of the overwrap layer 262 keeps thermal stress from exceeding the strength of the materials, preventing breakage during operation.

In addition to forming a continuous reinforced structure, the overwrap layer 262 has sufficient polymeric material to act as an adhesive during installation of the composite material, so the module assembly 250 forms a structurally sound module. This bonding of the bottle assembly 200 and the composite wrap allows the module assembly 250 to withstand the continual voltage stress placed on it in use.

As the composite wrap 262 and the bottle assembly 200 have similar thermal coefficients of expansion, thermal stresses are alleviated and the need for a buffer material such as a separate rubber sleeve surrounding the bottle assembly 200, as is used is some conventional types of switchgear, may be eliminated. Thus, the module assembly 250 uses fewer parts, eliminates manufacturing steps, and is less costly than conventional epoxy encapsulated vacuum switchgear.

After the overwrap layer 262 is fully cured, the wrap layer 262 is cut away in the region of a threaded cross-hole 272 in the external current interchange 260. The cross hole 272 accepts a contact for connection to a power cable when the module assembly 250 is assembled into an active switchgear element assembly, such as the switch or interrupter element assemblies 150 and 152 (FIG. 3), as explained below.

Figure 7:
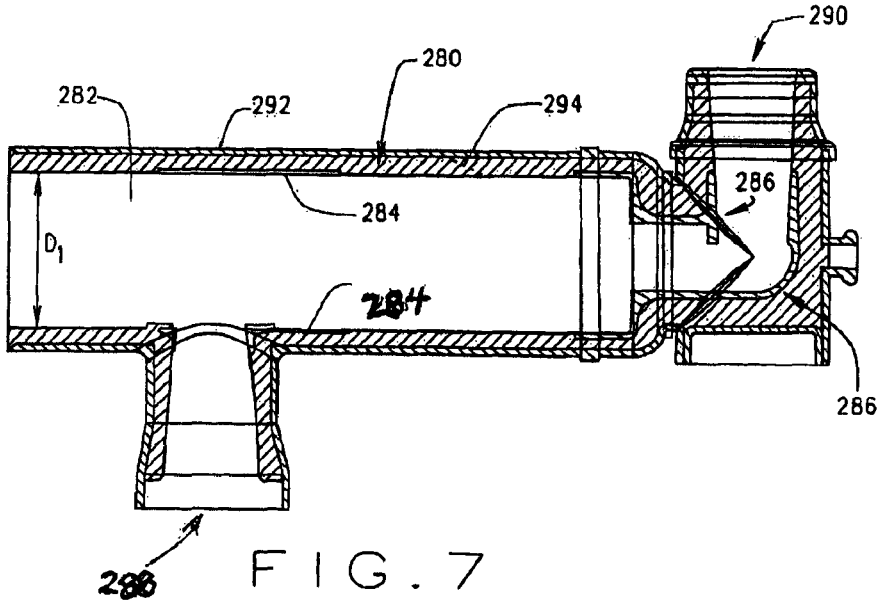
FIG. 7 is a cross sectional view of an insulating housing which may be used with the switch or interrupter module shown in FIGS. 5 and 6.

FIG. 7 is a cross sectional view of an exemplary insulating housing 280 which may be used with the switch or interrupter module 250 (shown in FIG. 6).

In an exemplary embodiment, the insulating housing 280 is fabricated from an elastomeric material having a low modulus and high elongation to define a flexible or resilient structure according to a known process. In one embodiment, the housing may be fabricated from molded rubber into a generally cylindrical or tubular body having a central bore 282 dimensioned to accommodate the module assembly 250 (FIGS. 5 and 6) therein. Internal stress relief inserts 284, 286 are fabricated from conductive rubber and are applied to designated portions of the inner surface of the housing 280 to maintain a uniform voltage within the volume they enclose. The inserts 284, 286 prevent discharges from occurring inside the regions they enclose. Mating interfaces 288, 290, sometimes referred to as bushings, are molded into and extend from the housing 280, and the interfaces 288 and 290 accept mating parts that enable the module 250 to be connected to an electrical system via, for example, the switchgear 100 (shown in FIGS. 1-3).

An outer conductive ground shield 292 surrounds substantially the entire exterior surface of the housing 280 in an exemplary embodiment, and for safety reasons the ground shield 292 is maintained at ground potential when the module 250 is energized.

An inner diameter $D_1$ of the rubber housing 280 is slightly smaller than the outer diameter $D_2$ of the module 250 (FIG. 6). When the module 250 is inserted into the housing 280, the resulting interference between the outer surface of the module 250 and the inner surface of the housing 280 allows the entire assembly to withstand the applied voltage when the contacts 210, 208 of the bottle assembly 200 (FIG. 4) are open or closed. The intimate fit between the interfering surfaces of the module assembly 250 and the housing 280 also forces air from the interface between the two surfaces, thereby preventing air gaps and associated electrical discharges that could cause electrical failures.

In one embodiment, the housing 280 may be formed in a single piece, monolithic construction. In another embodiment, the housing may be formed of two or more pieces joined at a tapered, overlapping seam 294 (shown in phantom in FIG. 7) to ensure adequate dielectric strength.

Figure 8:
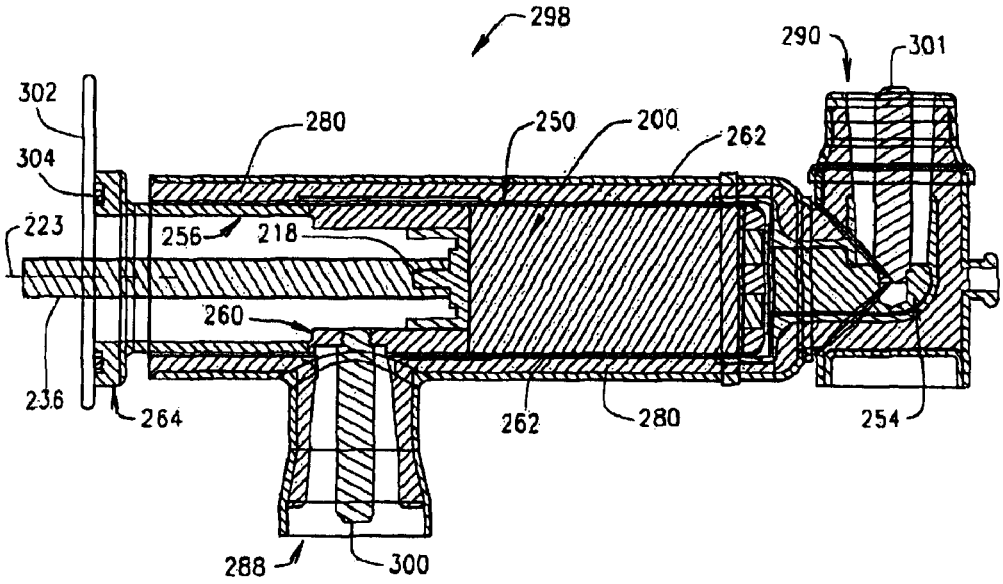
FIG. 8 is a cross sectional view of a switch or interrupter assembly including the housing shown in FIG. 7 and the switch or interrupter module shown in FIG. 5.

FIG. 8 is a cross sectional view of an exemplary switch or interrupter assembly 298 including the housing 280 with the switch or interrupter module 250 inserted therein. The composite overwrap layer 262 is sandwiched between the housing 280 and the bottle assembly 200. The overwrap layer 262 directly contacts the outer surface of the bottle without the presence of any intervening layers or materials, and also directly contacts the inner surface of the insulating housing 280.

Various fixtures and guides are used to ensure the threaded hole 272 (FIG. 6) in the module 250 and the location of the interface 288 of the housing 280 correspond in location, and further so that the contact 254 and the location of the interface 290 of the housing 280 correspond in location. A module contact 300 is attached to the module 250 through the threaded hole 272 and engages the external current exchange 260 of the module 250. In the illustrated embodiment, this connection is threaded but this function may be accomplished by other techniques in other embodiments. A module contact 301 is received in the interface 290 and is threaded to the contact 254, although other non-threaded attachment schemes could likewise be employed in other embodiments.

The operating shaft 236 is attached by threading it to the movable contact 210 (FIG. 4) via the rod 218 in the illustrated embodiment, although it is contemplated that non-threaded attachments or connections may be established in alternative embodiments. The operating mechanism, represented by a stationary plate 302 thereof, is joined with the end 264 of the throat connector 256, and a gasket 304 seals the entry between the throat connector 264 and the operating mechanism. Mating connectors, sometimes referred to as bushings or elbows mate with the interfaces 288, 290 and the respective contacts 300, 301 to connect the assembly 298 to power cables and the bus bar as described above with respect to FIGS. 1-3.

As shown in FIG. 8, the overall switch or interrupter assembly 298 is constructed in a "Z" shape or configuration in an exemplary embodiment. In another embodiment, the end bushing/elbow interfaces 288, 290 may alternatively be formed in a "C" shape or configuration in the overall assembly 298, or still alternatively with an "L" shape, a "V" shape, or a "T" shape or configuration at either end or with connections in line with the axis 223 of the assembly 298. A two-piece rubber housing 280 is effective at allowing the alternate shapes to be created and used. The alternate shapes may be used to help the user of the module connect the module 250 to the electrical system in varying ways to make the module easier and safer to install and operate.

Once connected to the operating mechanism plate 302, which is securely mounted in a stationary manner, the overwrap layer 262 provides a rigid mechanical connection to the plate 302 at one end and the stationary end 228 of the bottle assembly 200 at the other end. Thus, once assembled to the operating mechanism, the bottle assembly 200 is assured to remain aligned with the operating shaft 236 to avoid structural loading of the bottle assembly to which known vacuum switch or interrupter devices are susceptible. Additionally, any axial or non-axial loading that may occur due to normal or abnormal operation of the actuator shaft 236 is borne by the overwrap layer 262 and not the bottle assembly 200 (or the insulator 202) due to the direct contact of the overwrap layer 262 and the bottle outer surface. The rigid continuous reinforcement of the overwrap layer forms a self supporting and structurally adequate assembly 298 to withstand operating forces and applied loads in use more capably, and because the overwrap layer 262 expands and contract at roughly the same rate as the bottle assembly 200, thermal stresses are substantially reduced in the overall assembly 298.

While the above-described construction of the switch and interrupter assembly 298 provides a number of benefits and advantages over known switching and protective elements used in conventional switchgear, the overwrap layer 262 may present a vulnerability to certain failure conditions. In particular, any surface voids or imperfections on the surface of overwrap layer 262 may concentrate electrical stress on the interface boundary between the overwrap layer 262 and the housing 280. Voltage tracking, or carbonization of a path, may result due to the presence of this electrical stress. Such tracking, if it bridges between two different high voltage potentials, or between high voltage and ground, can cause an electrical failure of the switch or interrupter assembly 298. This is particularly true for higher operating voltages.

Figure 9:
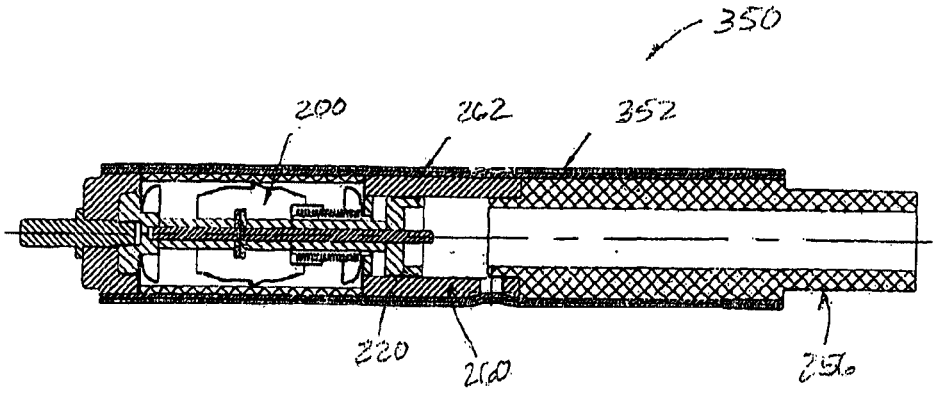
FIG. 9 is a cross sectional view of a switch or interrupter module according to another embodiment of the present invention.

FIG. 9 is a cross sectional view of a switch or interrupter module 350 according to another embodiment of the present invention that is similar in some aspects to the module 250 described above, but avoids problems associated with electrical stress and voltage tracking to which the module 250 is susceptible when fitted within an elastomeric housing as described above. Like reference characters are likewise utilized to denote similar features of the foregoing module 250 (FIGS. 5 and 6) and the module 350 shown in FIG. 9.

Like the module 250, the module 350 includes the bottle assembly 200, the current exchanges 220 and 260, and the throat connector 256. Unlike the module 250, however, the module 350 includes a mechanically compliant dielectric layer 352, sometimes referred to as an insulating buffer, added on the outside of the overwrap layer 262. The mechanically compliant dielectric layer 352 may be, for example, a silicon rubber sleeve, applied to the outside of the composite-wrapped assembly using a vacuum manifold having an opening large enough to accommodate the bottle assembly 200. The sleeve may be placed within the vacuum manifold in a relaxed state, and by withdrawing air from the vacuum manifold and by optionally using an inflatable bladder, the sleeve may be expanded to about two and a half times its original diameter in one example with suction of the vacuum manifold holding the sleeve open. The module 250 including the overwrap layer 262 may then be inserted in the expanded sleeve, and the suction in the vacuum manifold may be discontinued to cause the sleeve to collapse around the module 250 to form the compliant dielectric layer 352 surrounding the bottle assembly and associated components. Further details regarding the vacuum manifold and methodology for such a collapsible sleeve are described in the commonly owned U.S. Pat. No. 5,917,167, the disclosure of which is hereby incorporated by reference in its entirety. Notably, however, epoxy encapsulants materials that are cast around the bottle assembly as described in U.S. Pat. No. 5,917,167 are not used to fabricate the module 350.

Figure 10:
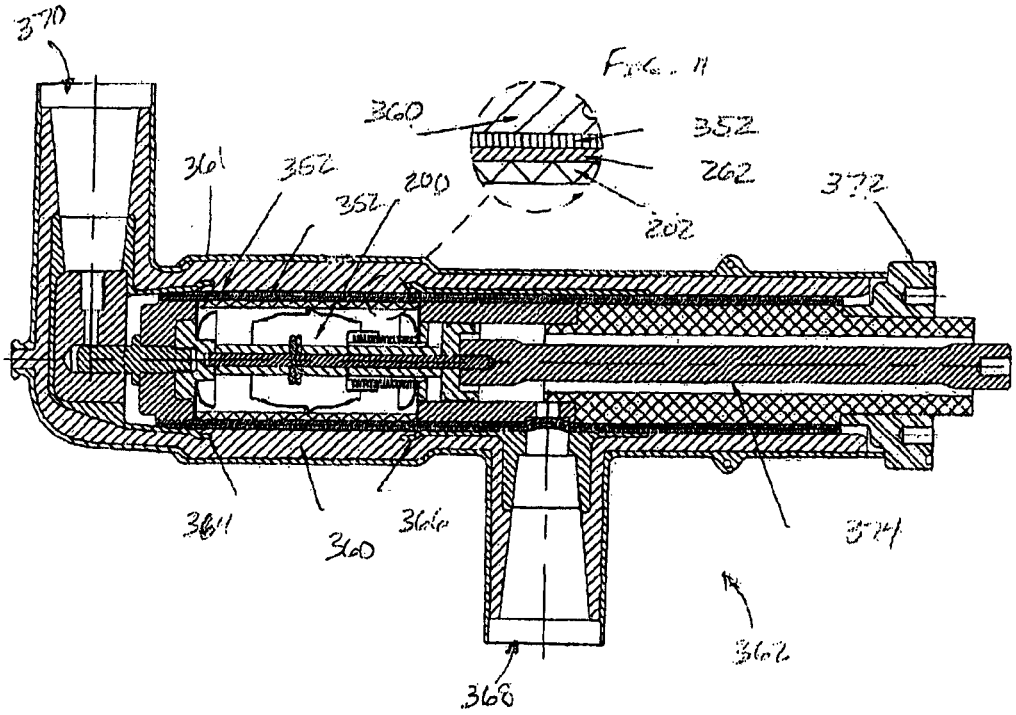
FIG. 10 illustrates the module of FIG. 9 installed within an insulative housing.
Figure 1:
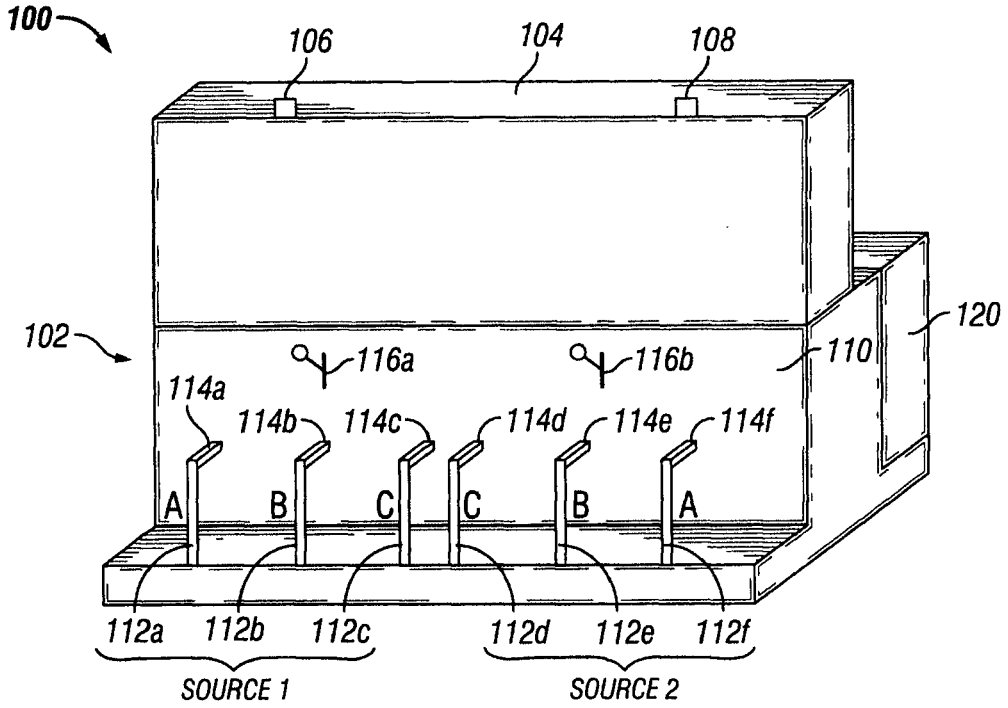
Figure 2:
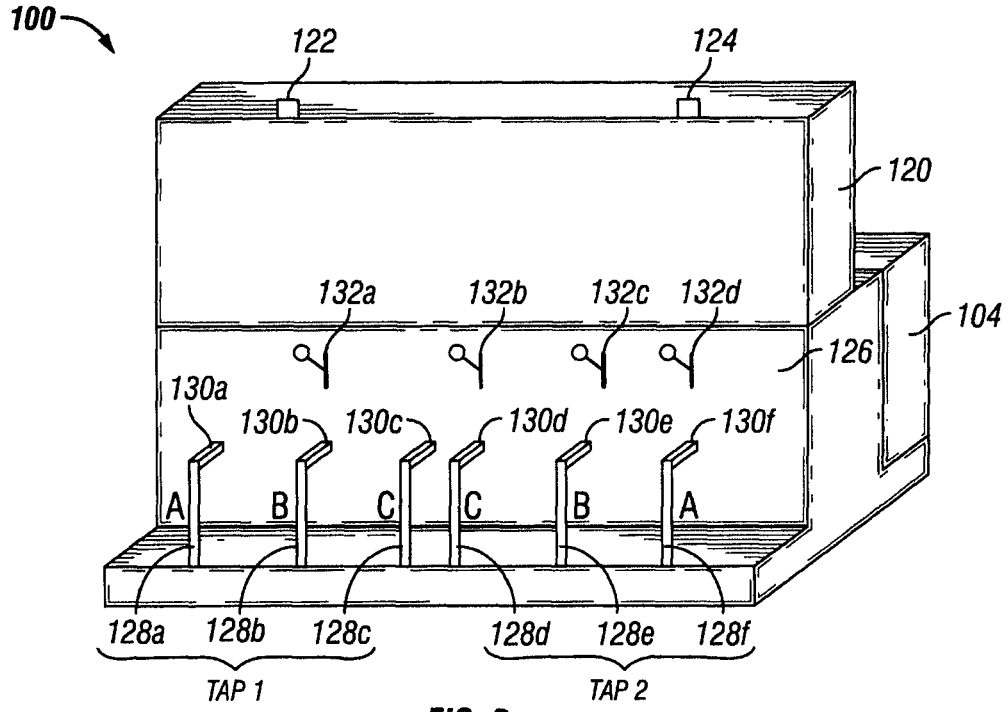
Figure 3:
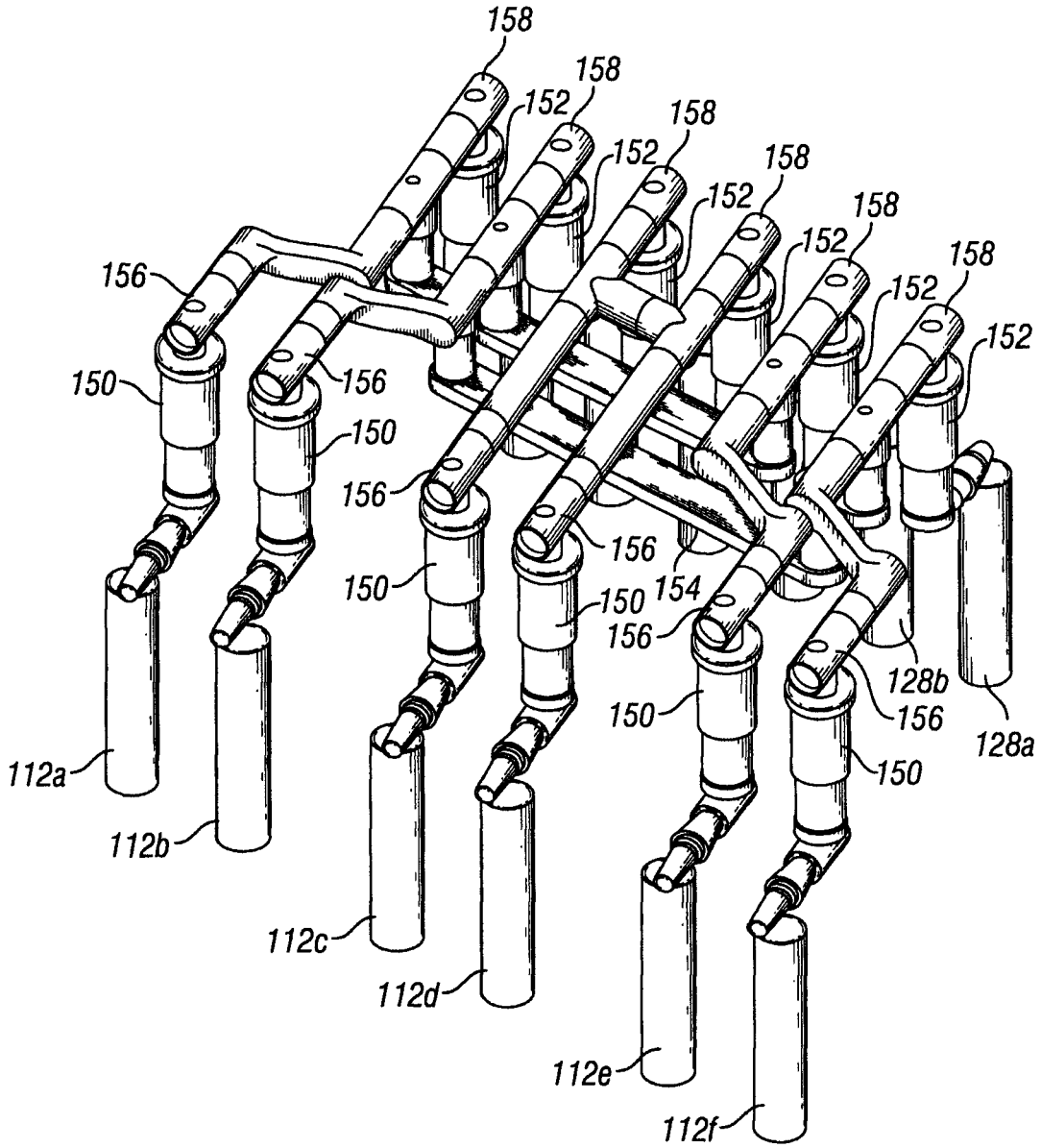
Figure 4:
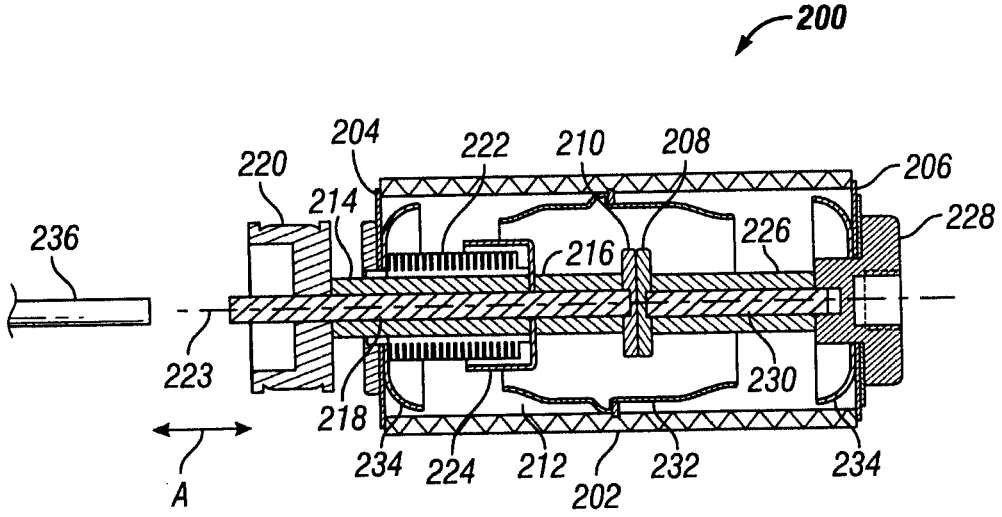
Figure 5:
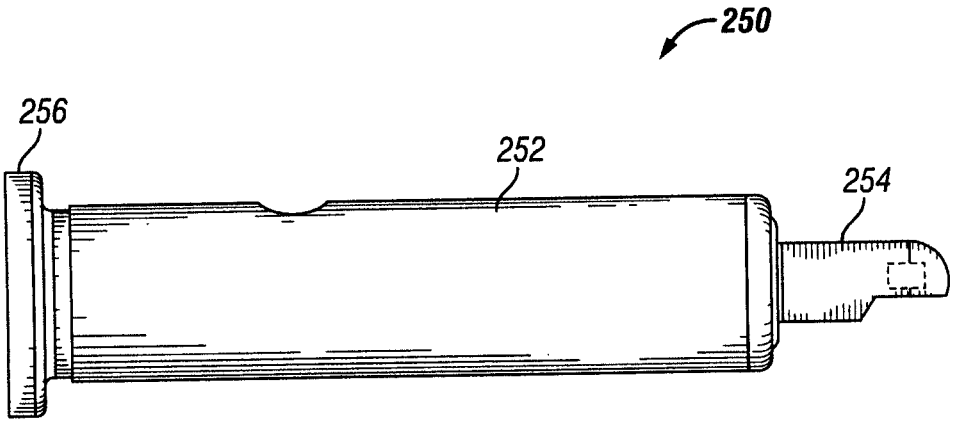
Figure 6:
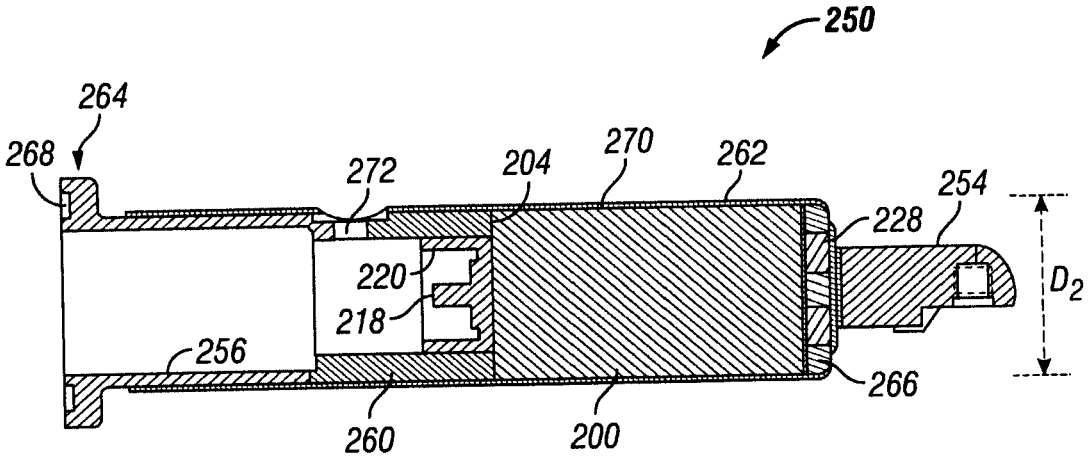
Figure 7:
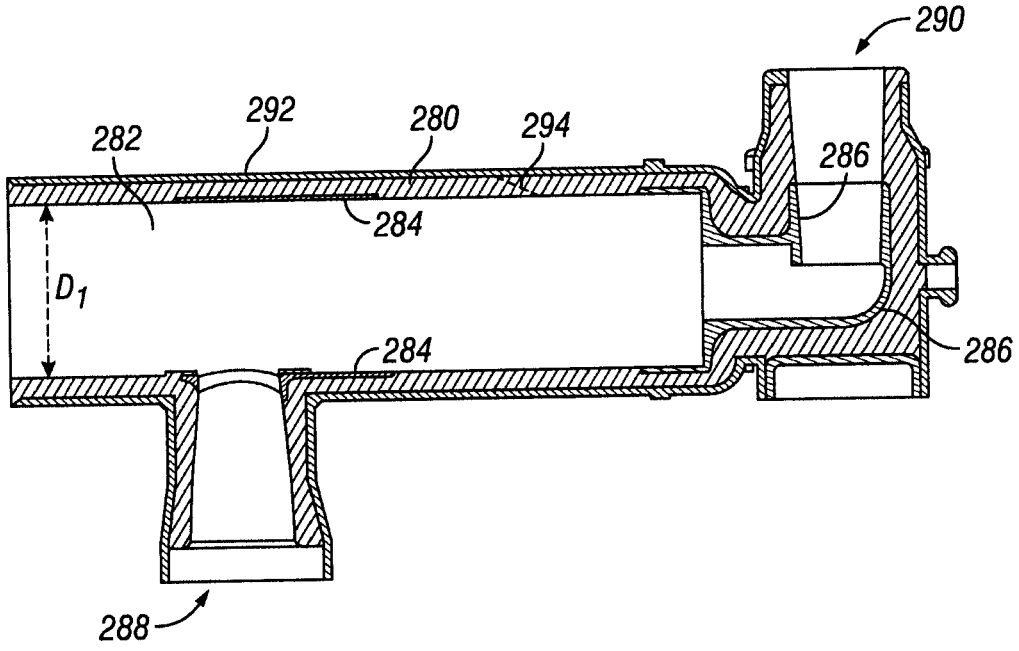
Figure 8:
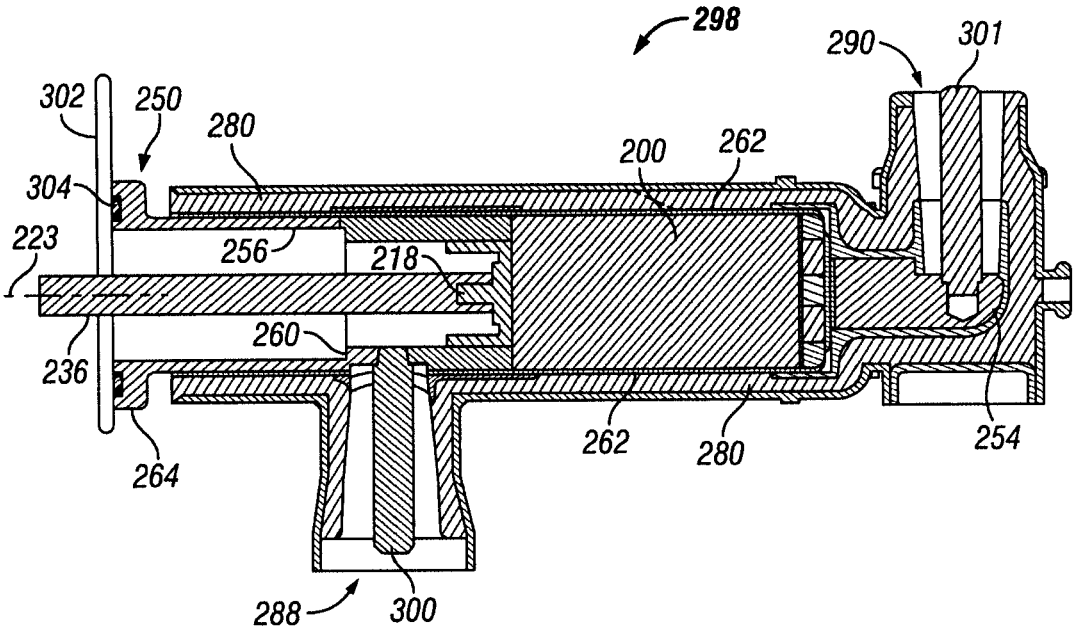
Figure 9:
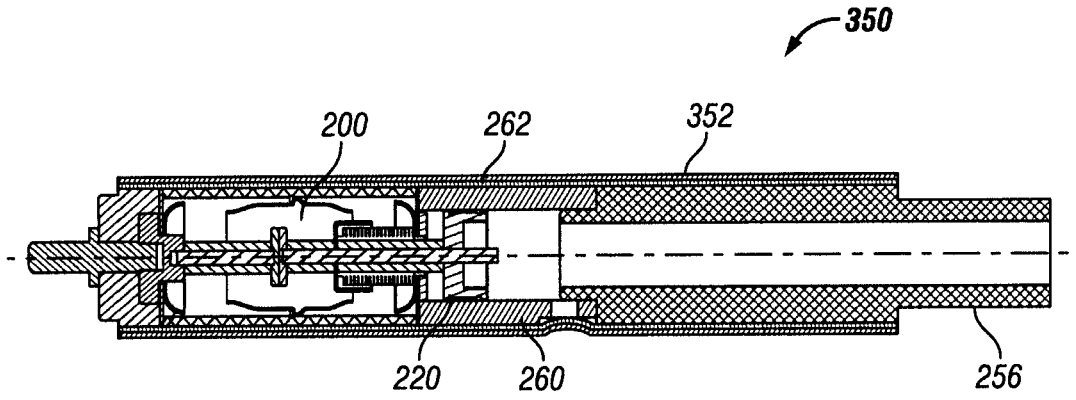
Figure 10:
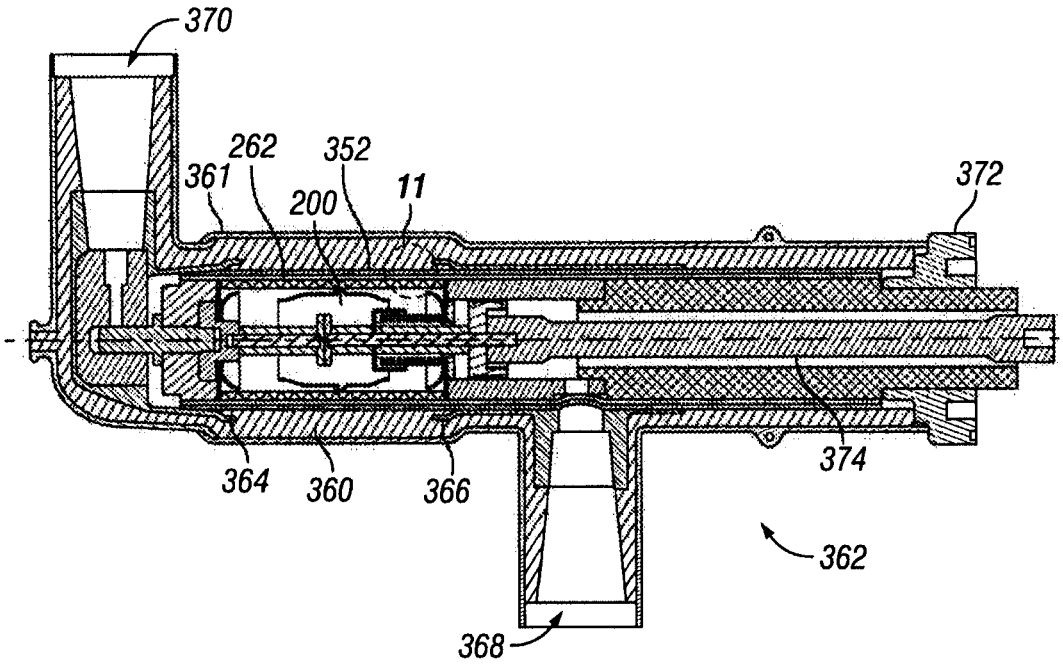

Once the compliant dielectric buffer layer 352 is formed to complete the module 350, the module 350 may be inserted into or otherwise fitted within, as shown in FIG. 10, an elastomeric housing 360 to form a switch or interrupter element assembly 362 that may be utilized with high voltage switchgear such as that described above. In an exemplary embodiment, the housing 360 may be fabricated from EPDM rubber or another material that is compliant enough to be stretched over and placed around and in intimate contact with the module 350. Optionally, a lubricant such as a known dielectric grease or oil may be utilized to ease the insertion of the module 350 into the housing 360.

In accordance with the housing 280 previously described, the housing 360 may be provided with an outer shell 361 of conductive rubber, for example, that is maintained at ground potential for safety reasons. To mitigate voltage stress, the housing 360 may be provided with conductive stress relief inserts 364 and 366 at the mating bushing and elbow interfaces 368, 370 of the housing 360. A connector 372 is provided at an end of the assembly to fix the assembly 362 to a fixed support, and an operating shaft 374 extends to and mechanically connects, via threaded engagement for example, with the movable components of the bottle assembly 200 so as to position the movable contact therein selectively relative to the fixed contact as described above.

Figure 11:
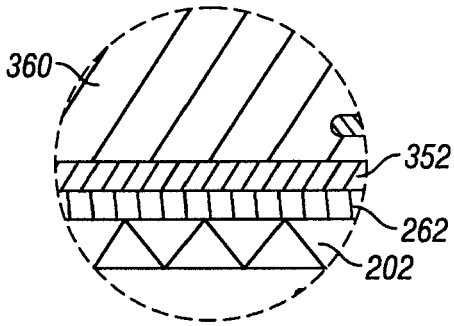
FIG. 11 is a magnified view of a portion of FIG. 10.

As best seen in FIG. 11, the compliant dielectric layer is sandwiched between and in intimate or direct contact with the housing 360 on one side and the overwrap layer 262 on the other side. Likewise, the composite overwrap layer 262 is sandwiched between and in direct contact with the bottle assembly insulator 202 on one side and the compliant dielectric layer 352 on the other side. Mechanical and electrical isolation of the bottle assembly 200 is therefore provided in a compact yet highly effective arrangement for higher voltage ratings of the assembly 362.

While the assembly 362 thus far described includes a single overwrap layer 262 and a single compliant dielectric buffer layer 352 in direct or intimate contact with one another, it is understood that more than one overwrap layer and/or more than one compliant buffer layer may be provided in further embodiments. It is also understood, however, that in alternative embodiments, intervening layers or materials may be provided in another embodiment, with the intervening layers or materials situated between the overwrap layer 262 and the compliant dielectric layer 352 as opposed to the direct, intimate, surface-to-surface engagement of the layers 262 and 352 as shown in FIG. 11. Likewise, it is contemplated that one or more intervening layers or materials may be provided and situated between the compliant dielectric buffer layer 352 and the housing 360 in another embodiment as desired, as opposed to the direct, intimate, surface-to-surface engagement of the layer 352 and the housing 360 as shown in FIG. 11. Finally, one or more intervening layers or materials may be provided and situated between the bottle assembly insulator 202 and the overwrap layer 262 in another embodiment as desired, as opposed to the direct, intimate, surface-to-surface engagement of the overwrap layer 262 and the bottle insulator 202 as shown in FIG. 11.

The assembly 362 is advantageous in several aspects in comparison to the assembly 298 using the module 250 described above. In the assembly 362, and by virtue of the compliant dielectric layer 352, electrical stress is lowered on the surface of the composite wrap layer 262 by nature of it being placed further from sources of electrical stress at the inserts 364 and 366 by the thickness of the buffer layer 352. The assembly 362 is accordingly less sensitive to voids and imperfections on the surface of the composite wrap layer 262 than in the assembly 298.

The assembly 362 may also be less sensitive to voltage tracking because the compliant dielectric layer 352 is fabricated from a material having mechanical and electrical properties more similar to that of the housing 360 in comparison to the overwrap layer 262. For instance, the compliant dielectric layer 352 in one embodiment be fabricated from silicon rubber, and the housing 360 may be fabricated from EPDM rubber, each of which exhibits similar mechanical and electrical properties. Furthermore, in order for electrical stress to cause tracking on the surface of composite wrap layer 262 in the assembly 362 from stress and voltage at the insert 366, for instance, it must first electrically fail and puncture the compliant dielectric layer 352. Thus, the layer 352 is sometimes referred to as a buffer because it provides a mechanical and electrical buffer between the overwrap layer 262 and the inner surfaces of the housing 360.

The dielectric layer 352 may also be made of a relatively softer material than either the housing 360 or the composite wrap layer 262. That is, the dielectric layer 352 and the housing 360 may be fabricated from materials having different durometer, compliancy, or elasticity. For instance, the composite wrap layer 262 may be considered a solid, and the housing 360 may be fabricated from a rubber material, for example, having a durometer of about 70 or 80 (Shore A scale). The compliant dielectric layer 352 may be fabricated from, for example, a silicon rubber having a durometer of about 30 to 40 (Shore A) when in the non-expanded state, and of about 50 to 60 (Shore A) in the expanded state. In such an embodiment, the compliant dielectric layer may conform extremely well to surface imperfections and discontinuities in the surface of composite wrap layer 262. That is, the compliant layer 352 may deform and be pushed into place by the relatively harder rubber of housing 360 during assembly. In such a manner, the compliant dielectric layer 352 may completely fill any voids that may be present in the boundary between the overwrap layer 262 and the housing 360, reducing the likelihood of surface voids and imperfections of the overwrap layer 262 leading to voltage tracking. The compliant dielectric layer also reduces a likelihood that surface imperfections on the inside diameter of the housing 360 may lead to voltage tracking.

While one exemplary process of forming the compliant dielectric layer 352 using a vacuum manifold has been described, it is understood that the compliant dielectric layer may be formed in another manner if desired in alternative embodiment of the invention. For example, a composite-wrapped bottle assembly may be inserted loosely into an oversized housing similar to the housing 360 and potted in place with an elastomeric potting compound.

Likewise, while the compliant dielectric layer 352 is shown over the entire outside surface of the composite overwrap layer 262 in FIGS. 9 and 10, the compliant dielectric layer 352 may extend only over selected portions of the overwrap layer 262 if desired. For example, the compliant dielectric layer 352 may be provided only over the bottle assembly 200 if desired. As another example, the compliant dielectric layer 352 may be provided only over the connector 256, depending on the specific design or application. As still another example, the compliant dielectric layer 352 may be provided around areas of high electrical stress proximate the inserts 364 and 366, as opposed to other locations in the assembly.

In still further embodiments, the overwrap layer 262 may be selectively provided in portions of the assembly 362, rather than extending substantially entirely over the entire module 350 as shown in FIGS. 9 and 10. For example, the composite overwrap layer 262 may be provided only to reinforce the bottle assembly 200, and particularly the insulator of the bottle assembly. Other mechanical joints of components may be structurally reinforced via, for example, roll pins or gluing as desired.

Various embodiments of the invention have now been disclosed, and it is believed that the advantages of the invention have been amply demonstrated.

An embodiment of a switchgear element assembly is disclosed herein. The assembly comprises: an insulator defining a bore and having a fixed contact therein; a movable contact mounted to the insulator and selectively positionable relative to the fixed contact; an overwrap layer of composite material substantially surrounding an outer surface of the insulator; an elastomeric insulating housing enclosing the insulator; and a compliant dielectric layer overlying the overwrap layer and buffering the overwrap layer from the housing; wherein the insulator is supported by the overwrap layer.

Optionally, the compliant dielectric layer comprises a sleeve, and the sleeve may be expanded and collapsed on the overwrap layer. The compliant dielectric layer may conform to voids and imperfections in the composite overwrap layer, and may be softer than the elastomeric insulating housing. The overwrap layer of composite material may directly contact an outer surface of the insulator. The overwrap layer of composite material may have a thermal coefficient of expansion approximately equal to a thermal coefficient of expansion of the insulator. The overwrap layer of composite material may comprise a matting or continuous strands of insulating material embedded in a polymeric compound that becomes rigid when the composite material is cured. The elastomeric housing may be fabricated from EPDM rubber.

An embodiment of a switchgear element for electrical switchgear is also disclosed. The element comprises: a substantially nonconductive elastomeric housing; a vacuum bottle assembly within the housing, the bottle assembly having a fixed contact therein and a movable contact mounted thereto, the movable contact positionable relative to the fixed contact; a connector configured for attachment to a stationary support, the connector positioned within the nonconductive housing at an end thereof opposite the bottle assembly; an overwrap layer of composite material applied to an outer surface of the bottle assembly and rigidly supporting the bottle assembly, the overwrap layer configured to isolate the vacuum bottle assembly from mechanical loads; and a compliant dielectric layer overlying the overwrap layer and adapted to fill any voids or discontinuities in the overwrap layer; wherein the compliant dielectric layer extends between the elastomeric housing and the overwrap layer.

Optionally, the compliant dielectric layer comprises a sleeve, and the sleeve may be expanded and collapsed on the overwrap layer. The compliant dielectric layer may conform to voids and imperfections in the composite overwrap layer. The compliant dielectric layer may be softer than the nonconductive elastomeric housing, and may fill voids in a surface of the overwrap layer. The compliant dielectric layer may be sandwiched between and may be in intimate contact with the overwrap layer and an inner surface of the elastomeric housing. The overwrap layer of composite material may have a thermal coefficient of expansion approximately equal to a thermal coefficient of expansion of an insulator of the vacuum bottle assembly.

Also disclosed in an embodiment of a vacuum switchgear element for electrical switchgear. The element comprises: a substantially nonconductive elastomeric housing; a vacuum bottle assembly within the housing, the bottle assembly having a fixed contact therein and a movable contact mounted thereto, the movable contact positionable relative to the fixed contact between open and closed positions; a connector configured for attachment to a stationary support, the connector positioned within the housing at an end thereof opposite the bottle assembly; and a rigid support structure extending between the stationary support on one end of the housing and the bottle assembly on an opposite end of the housing, the support structure comprising a composite overwrap material coupled to the vacuum bottle assembly and configured to isolate the vacuum bottle assembly from mechanical loads when connected to the switchgear; and a compliant dielectric buffer extending over at least a portion of the overwrap material and providing an electrical buffer proximate a high electrical stress area in the elastomeric housing.

An embodiment of an electric switchgear system is also disclosed. The system comprises: a bus bar system; a plurality of active switchgear elements coupled to the bus bar system; a plurality of power cables each respectively connected to the respective active switchgear elements; and an operating mechanism for opening and closing the active switchgear element. At least one of the plurality of active switchgear elements comprises: an insulating housing having a solid body and defining a bore therethrough; a bottle assembly received in the bore and enclosed in the housing, the bottle assembly comprising a vacuum insulator, a movable contact actuated by the operating mechanism, a fixed contact, and an actuator connector; and a rigid support structure axially supporting and mechanically isolating the vacuum insulator from the operating mechanism; wherein the support structure comprises a composite overwrap layer directly contacting an outer surface of the insulator; and a compliant dielectric buffer material overlying the overwrap material and filling voids and imperfections of the overwrap layer when fitted within an elastomeric housing.

Optionally, the overwrap layer may have a thermal coefficient of expansion approximately equal to a thermal coefficient of expansion of the bottle assembly. The bus bar system may be a modular bus bar system.

An embodiment of a switchgear element assembly is also disclosed. The assembly comprises: insulator means for enclosing a fixed contact and for defining a vacuum chamber; movable contact means for completing and interrupting a conductive path through the fixed contact; housing means for enclosing the insulator means; means for mechanically isolating the insulator means from axial loads and supporting the fixed contact relative to an operating mechanism for positioning the movable contact means relative to the fixed contact, the means for mechanically isolating the insulator means substantially enclosing the insulator means and supporting the insulator means in a rigid manner without depending upon a reinforcing casting encapsulant, and the assembly being devoid of materials of indefinite shape and volume; and means for providing a dielectric buffer between at least a portion of the means for isolating and the housing means in an area of high electrical stress.

While the invention has been described in terms of various specific embodiments, those skilled in the art will recognize that the invention can be practiced with modification within the spirit and scope of the claims.

What is claimed is:

1. A switchgear element assembly, comprising:

a ceramic insulator defining a bore and having a fixed contact therein;

a movable contact mounted to the ceramic insulator and selectively positionable relative to the fixed contact;

an overwrap layer of composite material substantially surrounding and directly contacting at least a portion of an outer surface of the ceramic insulator;

an elastomeric insulating housing enclosing the ceramic insulator; and a compliant dielectric layer directly contacting and surrounding at least a portion of the overwrap layer, the compliant dielectric layer being disposed between the overwrap layer and the elastomeric insulating housing and buffering the overwrap layer from the elastomeric insulating housing;

wherein the ceramic insulator is supported by the overwrap layer, and wherein the overwrap layer of composite material comprises one of a matting of insulating material and a plurality of continuous strands of insulating material, the one of the matting of insulating material and the plurality of continuous strands of insulating material being embedded in a polymeric compound that becomes rigid when the composite material is cured.

2. The switchgear element assembly in accordance with claim 1, wherein the compliant dielectric layer comprises a sleeve.

3. The switchgear element assembly in accordance with claim 2, wherein the sleeve is a collapsible sleeve.

4. The switchgear element assembly in accordance with claim 1, wherein the compliant dielectric layer conforms to voids and imperfections in the overwrap layer.

5. The switchgear element assembly in accordance with claim 1, wherein the compliant dielectric layer is softer than the elastomeric insulating housing.

6. The switchgear element assembly in accordance with claim 1, wherein the compliant dielectric layer fills voids in a surface of the overwrap layer.

7. The switchgear element assembly in accordance with claim 1, wherein the compliant dielectric layer is substantially enclosed within the elastomeric insulating housing.

8. The switchgear element assembly in accordance with claim 1, wherein the overwrap layer of composite material has a thermal coefficient of expansion approximately equal to a thermal coefficient of expansion of the ceramic insulator.

9. The switchgear element assembly in accordance with claim 1, wherein the elastomeric housing is fabricated from EPDM rubber.

10. The switchgear element assembly in accordance with claim 1, wherein the overwrap layer comprises a rigid, self-supporting material.

11. A switchgear element for electrical switchgear, comprising:

a substantially nonconductive elastomeric housing;

a vacuum bottle disposed within the housing, the vacuum bottle having a fixed contact therein and a movable contact mounted thereto, the movable contact positionable relative to the fixed contact;

a connector configured for attachment to a stationary support, the connector positioned within the nonconductive housing, at an end thereof opposite the vacuum bottle;

an overwrap layer applied to an outer surface of the vacuum bottle and rigidly supporting the vacuum bottle, the overwrap layer comprising a rigid, self-supporting, material that isolates the vacuum bottle from mechanical loads; and a compliant dielectric layer directly contacting and surrounding at least a portion of the overwrap layer, the compliant dielectric layer being disposed between the overwrap layer and the housing and filling any voids and discontinuities in the overwrap layer.

12. The switchgear element in accordance with claim 11, wherein the compliant dielectric layer comprises a sleeve.

13. The switchgear element in accordance with claim 12, wherein the sleeve is a collapsible sleeve.

14. The switchgear element in accordance with claim 11, wherein the compliant dielectric layer conforms to voids and imperfections in the overwrap layer.

15. The switchgear element in accordance with claim 11, wherein the compliant dielectric layer is softer than the nonconductive elastomeric housing.

16. The switchgear element in accordance with claim 11, wherein the compliant dielectric layer is substantially enclosed within the nonconductive elastomeric housing.

17. The switchgear element in accordance with claim 11, wherein the compliant dielectric layer is sandwiched between and in intimate contact with the overwrap layer and an inner surface of the elastomeric housing.

18. The switchgear element in accordance with claim 11, wherein the overwrap layer has a thermal coefficient of expansion approximately equal to a thermal coefficient of expansion of an insulator of the vacuum bottle.

19. The switchgear element in accordance with claim 11, wherein the overwrap layer comprises one of a matting of insulating material and a plurality of continuous strands of insulating material, the one of the matting of insulating material and the plurality of continuous strands of insulating material being embedded in a polymeric compound that becomes rigid when the overwrap layer is cured.

20. A vacuum switchgear element for electrical switchgear, comprising:

a substantially nonconductive elastomeric housing;

a vacuum bottle disposed within the housing, the vacuum bottle having a fixed contact therein and a movable contact mounted thereto, the movable contact positionable relative to the fixed contact between open and closed positions;

a connector configured for attachment to a stationary support, the connector positioned within the housing, at an end thereof opposite the vacuum bottle;

a rigid support structure extending between the stationary support on one end of the housing and the vacuum bottle on an opposite end of the housing, the rigid support structure comprising a rigid, self-supporting overwrap material coupled to the vacuum bottle and configured to isolate the vacuum bottle from mechanical loads when connected to the switchgear; and a compliant dielectric buffer extending over at least a portion of the overwrap material, the compliant dielectric buffer being disposed between the overwrap material and the housing and providing an electrical buffer proximate a high electrical stress area in the housing.

21. The vacuum switchgear element in accordance with claim 20, wherein the compliant dielectric buffer comprises a sleeve.

22. The vacuum switchgear element in accordance with claim 21, wherein the sleeve is a collapsible sleeve.

23. The vacuum switchgear element in accordance with claim 20, wherein the compliant dielectric buffer conforms to voids and imperfections in the overwrap material.

24. The vacuum switchgear element in accordance with claim 20, wherein the compliant dielectric buffer is softer than the nonconductive elastomeric housing.

25. The vacuum switchgear element in accordance with claim 20, wherein the compliant dielectric buffer fills voids in a surface of the overwrap material.

26. The vacuum switchgear element in accordance with claim 20, wherein the compliant dielectric buffer is sandwiched between and in intimate contact with the overwrap material and an inner surface of the elastomeric housing.

27. The vacuum switchgear element in accordance with claim 20, wherein the compliant dielectric buffer directly contacts at least a portion of an outer surface of the overwrap material.

28. The vacuum switchgear element in accordance with claim 20, wherein the overwrap material comprises one of a matting of insulating material and a plurality of continuous strands of insulating material, the one of the matting of insulating material and the plurality of continuous strands of insulating material being embedded in a polymeric compound that becomes rigid when the material is cured.

29. The vacuum switchgear element in accordance with claim 20, wherein the compliant dielectric buffer is substantially enclosed within the nonconductive elastomeric housing.

30. An electric switchgear system, comprising:

a bus bar system;

a plurality of active switchgear elements coupled to the bus bar system;

a plurality of power cables that are each respectively connected to at least one of the active switchgear elements; and an operating mechanism operable to open and close the active switchgear elements, wherein at least one of the plurality of active switchgear elements comprises:

an insulating housing having a solid body and defining a bore therethrough;

a vacuum bottle received in the bore and enclosed in the housing, the vacuum bottle comprising a vacuum insulator, a movable contact actuated by the operating mechanism, a fixed contact, and an actuator connector;

a rigid support structure axially supporting and mechanically isolating the vacuum insulator from the operating mechanism, the rigid support structure comprising an overwrap layer that directly contacts an outer surface of the insulator; and a compliant dielectric buffer material directly contacting and surrounding at least a portion of the overwrap material and filling voids and imperfections of the overwrap layer when fitted within the insulating housing, the compliant dielectric buffer material being disposed between the overwrap layer and the insulating housing, wherein the overwrap layer comprises one of a matting of insulating material and a plurality of continuous strands of insulating material, the one of the matting of insulating material and the plurality of continuous strands of insulating material being embedded in a polymeric compound that becomes rigid when the overwrap layer is cured.

31. The electric switchgear system in accordance with claim 30, wherein the overwrap layer has a thermal coefficient of expansion approximately equal to a thermal coefficient of expansion of the vacuum bottle.

32. The electric switchgear system in accordance with claim 30, wherein the bus bar system is a modular bus bar system.

33. The electric switchgear system in accordance with claim 30, wherein the compliant dielectric buffer comprises a sleeve.

34. The electric switchgear system in accordance with claim 33, wherein the sleeve is a collapsible sleeve.

35. The electric switchgear system in accordance with claim 30, wherein the compliant dielectric layer is softer than the insulating housing.

36. The electric switchgear system in accordance with claim 30, wherein the compliant dielectric layer is sandwiched between and in intimate contact with the overwrap layer and an inner surface of the insulating housing.

37. The electric switchgear system in accordance with claim 30, wherein the compliant dielectric buffer material directly contacts at least a portion of an outer surface of the overwrap layer.

38. The electric switchgear system in accordance with claim 30, wherein the overwrap layer comprises a rigid, self-supporting material.

39. The electric switchgear system in accordance with claim 30, wherein the compliant dielectric buffer is substantially enclosed within the insulating housing.

40. A switchgear element assembly, comprising:

an insulator defining a bore and having a fixed contact therein;

a movable contact mounted to the insulator and selectively positionable relative to the fixed contact;

an overwrap layer of composite material substantially surrounding and directly contacting at least a portion of an outer surface of the insulator, the composite material being formed from one of a matting of insulating material and a plurality of continuous strands of insulating material, the one of the matting of insulating material and the plurality of continuous strands of insulating material being embedded in a polymeric compound configured to become rigid when the composite material is cured;

an elastomeric insulating housing enclosing the insulator; and a compliant dielectric layer overlying the overwrap layer, the compliant dielectric layer being disposed between the overwrap layer and the elastomeric insulating housing and buffering the overwrap layer from the elastomeric insulating housing;

wherein the insulator is supported by the overwrap layer.

41. The switchgear element assembly in accordance with claim 40, wherein the compliant dielectric layer comprises a sleeve.

42. The switchgear element assembly in accordance with claim 41, wherein the sleeve is a collapsible sleeve.

43. The switchgear element assembly in accordance with claim 40, wherein the compliant dielectric layer conforms to voids and imperfections in the overwrap layer.

44. The switchgear element assembly in accordance with claim 40, wherein the compliant dielectric layer is softer than the elastomeric insulating housing.

45. The switchgear element assembly in accordance with claim 40, wherein the compliant dielectric layer fills voids in a surface of the overwrap layer.

46. The switchgear element assembly in accordance with claim 40, wherein the compliant dielectric layer directly contacts at least a portion of an outer surface of the overwrap layer of composite material.

47. The switchgear element assembly in accordance with claim 40, wherein the overwrap layer of composite material has a thermal coefficient of expansion approximately equal to a thermal coefficient of expansion of the insulator.

48. The switchgear element assembly in accordance with claim 40, wherein the elastomeric housing is fabricated from EPDM rubber.

* * * * *

UNITED STATES PATENT AND TRADEMARK OFFICE

CERTIFICATE OF CORRECTION

PATENT NO. : 7,772,515 B2
APPLICATION NO. : 11/673759
DATED : August 10, 2010
INVENTOR(S) : Stoving et al.

It is certified that error appears in the above-identified patent and that said Letters Patent is hereby corrected as shown below:

The Title Page, showing an illustrative figure, should be deleted and substitute therefor the attached title page.

Please replace all the drawings with new Figures 1-6 as attached.

Signed and Sealed this

Seventh Day of September, 2010

David J. Kappos

David J. Kappos
*Director of the United States Patent and Trademark Office*

(12) United States Patent
Stoving et al.

(10) Patent No.: US 7,772,515 B2
(45) **Date of Patent: *Aug. 10, 2010**

(54) VACUUM SWITCHGEAR ASSEMBLY AND SYSTEM

(75) Inventors: Paul N. Stoving, Oak Creek, WI (US); Michael P. Culhane, Delafield, WI (US)

(73) Assignee: Cooper Technologies Company, Houston, TX (US)

( * ) Notice: Subject to any disclaimer, the term of this patent is extended or adjusted under 35 U.S.C. 154(b) by 178 days.

This patent is subject to a terminal disclaimer.

(21) Appl. No.: 11/673,759

(22) Filed: Feb. 12, 2007

(65) Prior Publication Data

US 2007/0241080 A1 Oct. 18, 2007

Related U.S. Application Data

(63) Continuation-in-part of application No. 11/273,192, filed on Nov. 14, 2005, now Pat. No. 7,488,916.

(51) Int. Cl.
*H01H 33/66* (2006.01)

(52) U.S. Cl. ..... 218/134; 218/139; 218/155

(58) Field of Classification Search ..... 218/118–121, 218/134, 138–140, 152–155
See application file for complete search history.

(56) References Cited

U.S. PATENT DOCUMENTS

| | | | |
|---|---|---|---|
| 3,372,259 | A | 3/1968 | Porter |
| 3,469,050 | A | 9/1969 | Robinson et al. |
| 3,471,669 | A | 10/1969 | Curtis |
| 3,740,511 | A | 6/1973 | Westmoreland |
| 4,032,737 | A | 6/1977 | Huhse et al. |
| 4,071,727 | A | 1/1978 | Crouch et al. |
| 4,124,790 | A | 11/1978 | Kumbera et al. |
| 4,532,391 | A | 7/1985 | Bernt |
| 4,568,804 | A | 2/1986 | Luehring |
| 4,704,506 | A | 11/1987 | Kurosawa et al. |
| 4,839,481 | A | 6/1989 | Nash et al. |
| 4,871,888 | A | 10/1989 | Bestel |
| 4,982,059 | A | 1/1991 | Bestel |
| 5,004,877 | A | 4/1991 | Yin |
| 5,099,093 | A | 3/1992 | Schels et al. |
| 5,175,403 | A | 12/1992 | Hamm et al. |
| 5,252,913 | A | 10/1993 | Falkowski et al. |

(Continued)

FOREIGN PATENT DOCUMENTS

| | | | |
|---|---|---|---|
| DE | 19906972 | A1 | 2/1999 |

(Continued)

OTHER PUBLICATIONS

U.S. Appl. No. 11/881,952, Stoving.

(Continued)

*Primary Examiner*—Renee Luebke
*Assistant Examiner*—Marina Fishman
(74) *Attorney, Agent, or Firm*—King & Spalding LLP

(57) ABSTRACT

Insulated vacuum switchgear and active switchgear elements therefor are provided with a composite overwrap for mechanically isolating a vacuum insulator from axial loads in use without reinforcing or insulating encapsulations. A dielectric buffer layer is provided to fill voids or discontinuities in the overwrap.

48 Claims, 6 Drawing Sheets

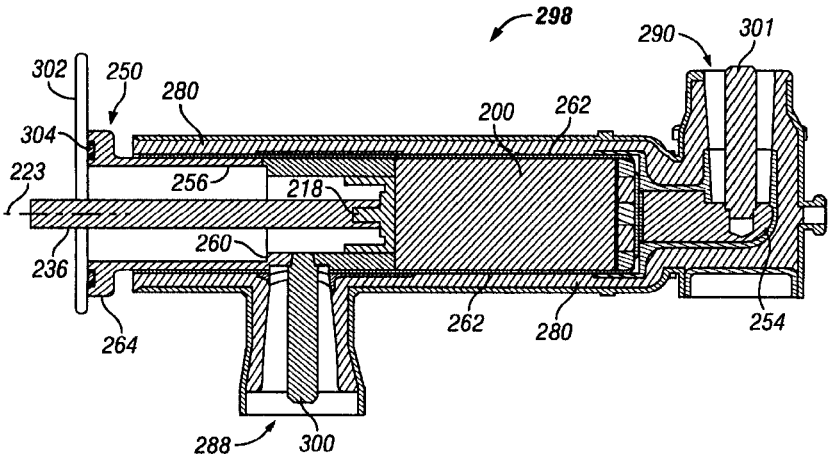

U.S. PATENT DOCUMENTS

| | | | | |
|---|---|---|---|---|
| 5,578,805 | A | * | 11/1996 | Berger et al. ..... 218/43 |
| 5,612,523 | A | | 3/1997 | Hakamata |
| 5,667,060 | A | | 9/1997 | Luzzi |
| 5,717,185 | A | | 2/1998 | Smith |
| 5,736,705 | A | | 4/1998 | Bestel et al. |
| 5,747,765 | A | | 5/1998 | Bestel et al. |
| 5,747,766 | A | | 5/1998 | Waino et al. |
| 5,777,287 | A | | 7/1998 | Mayo |
| 5,793,008 | A | | 8/1998 | Mayo et al. |
| 5,804,788 | A | | 9/1998 | Smith |
| 5,808,258 | A | | 9/1998 | Luzzi |
| 5,861,597 | A | | 1/1999 | Bolongeat-Mobleu et al. |
| 5,864,942 | A | | 2/1999 | Luzzi |
| 5,912,604 | A | | 6/1999 | Harvey et al. |
| 5,917,167 | A | | 6/1999 | Bestel |
| 6,130,394 | A | | 10/2000 | Hogl |
| 6,163,002 | A | | 12/2000 | Ahn et al. |
| 6,248,969 | B1 | | 6/2001 | Komoro et al. |
| 6,362,445 | B1 | | 3/2002 | Marchand et al. |
| 6,376,791 | B1 | | 4/2002 | Watanabe et al. |
| 6,479,779 | B1 | | 11/2002 | Falkingham et al. |
| 6,506,992 | B2 | | 1/2003 | Kim |
| 6,686,552 | B2 | | 2/2004 | Nishijima et al. |
| 6,867,385 | B2 | | 3/2005 | Stoving et al. |
| 6,965,089 | B2 | | 11/2005 | Stoving et al. |
| 2002/0043514 | A1 | | 4/2002 | Kim |
| 2002/0144977 | A1 | | 10/2002 | Kikuchi et al. |
| 2004/0121657 | A1 | | 6/2004 | Muench et al. |
| 2004/0242034 | A1 | | 12/2004 | Rinehart et al. |
| 2007/0108164 | A1 | | 5/2007 | Muench et al. |
| 2007/0241080 | A1 | | 10/2007 | Stoving et al. |

FOREIGN PATENT DOCUMENTS

| | | |
|---|---|---|
| EP | 0782162 A2 | 7/1997 |
| WO | WO 00/41199 | 7/2000 |

OTHER PUBLICATIONS

U.S. Appl. No. 11/758,136, Stoving.
Greenwood, Allan, Vacuum Switchgear, The Institution of Electrical Engineers, London United Kingdom; 1994, pp. 109, 124-126.
U.S. Appl. No. 11/881,952, Stoving et al.
U.S. Appl. No. 11/673,759, Stoving et al.
U.S. Appl. No. 11/758,136, Stoving et al.

* cited by examiner